US010952550B2

(12) United States Patent
Santarelli et al.

(10) Patent No.: US 10,952,550 B2
(45) Date of Patent: Mar. 23, 2021

(54) FLEXIBLE ROW COUNT CARD TIER

(71) Applicant: American Greetings Corporation, Cleveland, OH (US)

(72) Inventors: Anthony Santarelli, North Olmsted, OH (US); Christopher Weigand, Sagamore Hills, OH (US)

(73) Assignee: American Greetings Corporation, Cleveland, OH (US)

( * ) Notice: Subject to any disclaimer, the term of this patent is extended or adjusted under 35 U.S.C. 154(b) by 19 days.

(21) Appl. No.: 16/377,363

(22) Filed: Apr. 8, 2019

(65) Prior Publication Data

US 2019/0307266 A1 Oct. 10, 2019

Related U.S. Application Data

(60) Provisional application No. 62/654,606, filed on Apr. 9, 2018.

(51) Int. Cl.

| | |
|---|---|
| ***A47F 5/10*** | (2006.01) |
| ***A47F 5/00*** | (2006.01) |
| *A47F 7/14* | (2006.01) |

(52) U.S. Cl.

CPC ..... *A47F 5/105* (2013.01); *A47F 5/0062* (2013.01); *A47F 7/145* (2013.01)

(58) Field of Classification Search

CPC ..... A47F 5/105; A47F 5/0062; A47F 7/145; A47F 7/146; A47F 7/147

USPC ..... 211/55, 52; 108/92

See application file for complete search history.

(56) References Cited

U.S. PATENT DOCUMENTS

| | | | | | |
|---|---|---|---|---|---|
| 918,186 | A * | 4/1909 | Morse | A47F 7/145 | 211/55 |
| 927,671 | A * | 7/1909 | Nicholson | A47F 3/00 | 312/278 |
| 1,035,553 | A * | 8/1912 | Doering | A47F 7/145 | 211/55 |
| 1,361,451 | A * | 12/1920 | Flannery, Jr. | A47F 3/00 | 312/117 |
| 1,594,754 | A * | 8/1926 | Reines | A47F 7/145 | 108/61 |
| 1,739,730 | A * | 12/1929 | Orthwine | A47F 5/0062 | 211/128.1 |
| 2,067,051 | A * | 1/1937 | Hall | A47F 7/145 | 211/55 |
| 2,943,742 | A * | 7/1960 | Colley | A47F 1/12 | 211/59.2 |
| 3,285,424 | A * | 11/1966 | Emery | A47F 7/145 | 211/55 |
| 3,892,450 | A * | 7/1975 | Kolster | A47F 7/144 | 312/117 |

(Continued)

*Primary Examiner* — Jonathan Liu
*Assistant Examiner* — Devin K Barnett
(74) *Attorney, Agent, or Firm* — Christine Flanagan

(57) ABSTRACT

A flexible row count card tier for attachment to a retail greeting card display unit. The flexible row count card tier contains both permanent card rows and flexible card rows. The flexible row count card tier may be adapted to have a differing number of card rows by opening or closing one or more of the flexible card rows. Closing a flexible card row creates one less row but increases the depth of the card row directly below the closed flexible card row. The number and depth of rows can be adjusted depending on the merchandising and card density need per season or retailer productivity.

16 Claims, 20 Drawing Sheets

(56) References Cited

U.S. PATENT DOCUMENTS 4,460,097 A * 7/1984 Darnell, II ..... A47F 7/145 211/189
D279,529 S * 7/1985 Denhoff ..... D6/675.3
4,613,047 A * 9/1986 Bushyhead ..... A47F 7/145 108/101
4,905,845 A * 3/1990 Broeker ..... A47F 7/145 211/128.1
5,040,688 A * 8/1991 Martin ..... A47F 5/108 211/128.1
5,758,781 A * 6/1998 Lord ..... A47F 7/145 211/128.1
5,915,571 A * 6/1999 Czalkiewicz ..... A47F 7/145 211/128.1
6,412,648 B1 * 7/2002 Woolnough ..... A47F 7/145 211/128.1
6,422,403 B1 * 7/2002 Woolnough ..... A47F 7/145 211/130.1
7,665,617 B2 * 2/2010 Shea ..... A47F 5/0838 211/59.1
7,886,916 B2 * 2/2011 Alyn ..... A47F 5/0807 211/55
7,900,784 B1 * 3/2011 Weigand ..... A47F 5/005 211/186
7,987,998 B1 * 8/2011 Belk ..... A47F 7/145 211/55
8,132,679 B2 3/2012 Berry et al.
8,333,284 B2 12/2012 Berry et al.
8,671,548 B2 3/2014 Berry et al.
8,931,746 B2 * 1/2015 Fanning, Jr. ..... A47F 7/0007 248/220.31
9,104,699 B2 * 8/2015 Kaprosy ..... G06F 16/50
9,119,489 B2 * 9/2015 Buettner ..... A47F 7/147
9,212,019 B2 12/2015 Frost
9,357,857 B2 * 6/2016 Brozak ..... A47F 5/108
9,451,838 B2 * 9/2016 Cayce ..... A47F 7/145
10,362,886 B2 * 7/2019 Bellar ..... A47B 47/0091
2001/0025823 A1 * 10/2001 Brozak ..... A47F 1/12 211/55
2004/0074855 A1 * 4/2004 Wons ..... A47F 7/145 211/55
2005/0133474 A1 * 6/2005 Nomoto ..... A47F 5/0062 211/128.1
2005/0139561 A1 * 6/2005 Ohkubo ..... A47F 5/0062 211/128.1
2008/0078728 A1 * 4/2008 Hodge ..... A47F 5/0846 211/55
2009/0234724 A1 * 9/2009 Bates ..... G09F 1/10 705/14.4
2010/0163501 A1 * 7/2010 Berry ..... A47F 5/0087 211/55
2010/0181449 A1 * 7/2010 Weigand ..... A47F 5/0884 248/226.11
2010/0282697 A1 * 11/2010 Weigand ..... A47F 7/144 211/50
2012/0318759 A1 * 12/2012 Buettner ..... A47F 7/147 211/55
2017/0318986 A1 * 11/2017 Santarelli ..... F16M 13/022
2019/0281999 A1 * 9/2019 Mayer ..... G09F 3/20
2019/0307266 A1 * 10/2019 Santarelli ..... A47F 5/0062

* cited by examiner

FLEXIBLE ROW COUNT CARD TIER

RELATED APPLICATIONS

This application is a non-provisional of and claims priority to U.S. Provisional Patent Application No. 62/654,606, filed on Apr. 9, 2018, a copy of which is incorporated herein by reference in its entirety.

FIELD OF THE INVENTION

The present invention is in the field of retail display fixtures, and it is more specifically directed to flexible fixtures for displaying greeting cards and other social expression products.

SUMMARY OF THE INVENTION

A flexible row count card tier for attachment to a retail greeting card display unit. The flexible row count card tier contains both permanent card rows and flexible card rows. The flexible row count card tier may be adapted to have a differing number of card rows by opening or closing one or more of the flexible card rows. Closing a flexible card row creates one less row but increases the depth of the card row directly below the closed flexible card row. The number and depth of rows can be adjusted depending on the merchandising and card density need per season or retailer productivity.

DETAILED DESCRIPTION OF PREFERRED AND ALTERNATE EMBODIMENTS

Figure 1:
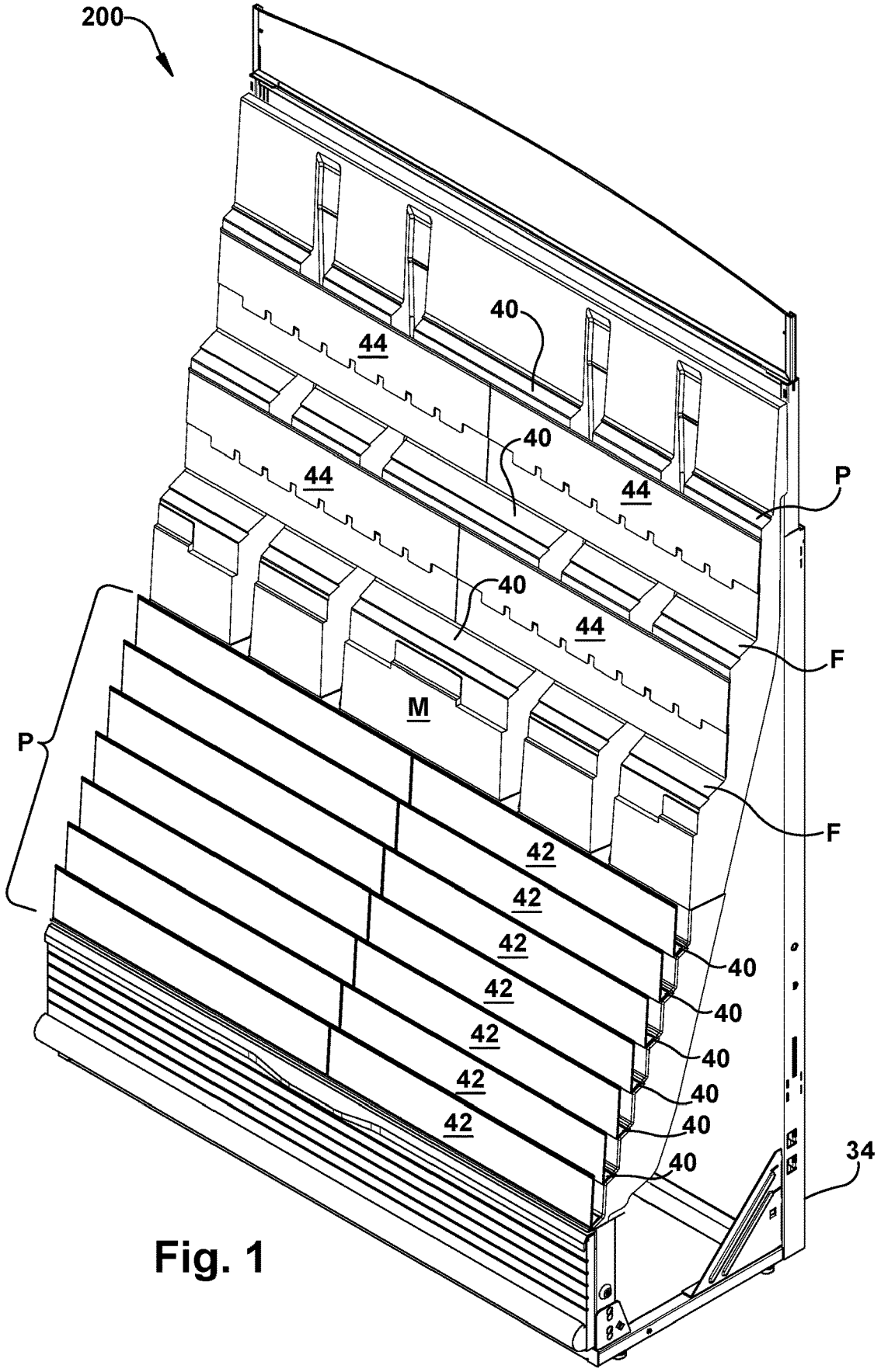
FIG. 1 is a perspective view of one embodiment of the greeting card display of the present invention, with flexible rows in a closed position.

With the advent of electronic and multi-media greeting card products, which tend to be much thicker than standard two-panel paper greeting cards, standard greeting card display fixtures, such as those used in a retail environment, were ill-equipped to store and display these thicker greeting cards. The rows or tiers of such greeting card display fixtures are typically vacuum formed and thus inflexible in the width and depth of said rows or tiers. The standard 1-inch tiers or pockets were able to hold and display very few electronic or multi-media cards in a stacked arrangement (as compared with traditional two panel paper greeting cards). In practice, differently configured card tiers are manufactured and used in different cases, depending on the mix of greeting cards to be displayed.

The flexible row count card tier of the present disclosure and related inventions allows more flexibility as the card tier may contain one or more flexible card rows that are capable of being moved between open and closed positions. When a flexible card row is in a closed position, the card row directly below the closed flexible card row is expanded into a 2-inch card row. When the flexible card row is in an open position it creates two 1-inch card rows.

First Embodiment

In a first embodiment, shown in FIGS. 13 through 23B, the greeting card tier 12, contains five (5) flexible card rows F. Each flexible card row F is located between two permanent card rows P. This greeting card tier 12 may contain twelve (12) 1-inch card rows, seven (7) 2-inch card rows or various combinations of 1- and 2-inch card rows.

The flexible row count card tier 100 includes a card tier 12, a plurality of flexible card rows F, a plurality of permanent card rows P. The card tier 12, in a one embodiment, is vacuum formed from an extruded plastic sheet. The front wall (or permanent sham) 16 of each permanent card row P and a plurality of tier inserts 18 are injection molded and are assembled and then secured to the vacuum formed card tier 12 by either sonic welding or pop rivet fastener. A plurality of card divider clips 14 may be inserted over each card row along the width of each row to divide the row into individual card pockets into which a group of greeting cards may be inserted.

Figure 16:
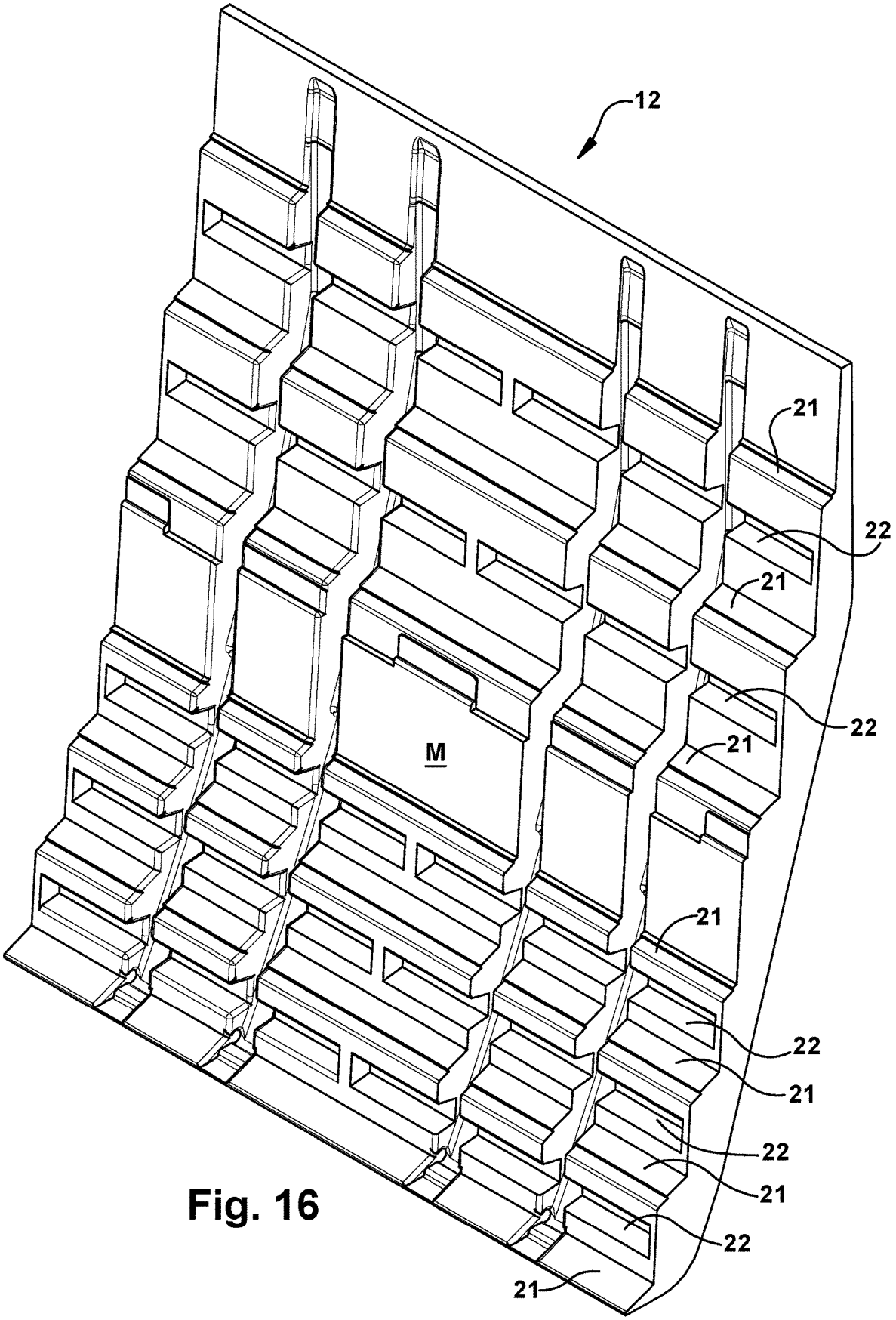
FIG. 16 is a perspective view of a greeting card tier.

The card tier 12 can be attached to a display module 20 which is made up of a stand or base which provides a foundation for the card tier 12 for placement on retail floor space. The display module 20 may further contain an arrangement of horizontal and vertical members extending upward from the stand or base to create a substantially planar, upright back support onto which the card tier 12 is attached. The card tier 12, as shown in FIG. 16, contains various indented or depressed areas 22 which are formed to accommodate insertion of the tier inserts 18, with a section located mid-height for the attachment of a mid-strip channel M. The card tier 12 also contains slots or openings which accommodate a snap-fit of the permanent card rows P. In one embodiment, the card tier 12 is approximately 24-inches wide. It contains various tiers or steps, arranged in a downward cascading manner wherein beginning with the uppermost row, each successive tier or step projects downward and outward from each preceding step, with each row being at a lower elevation and a position slightly in front of the row directly above. Each substantially horizontal step or section serves as the floor 21 of each permanent card row P which supports a plurality of greeting cards placed thereon.

Figure 13B:
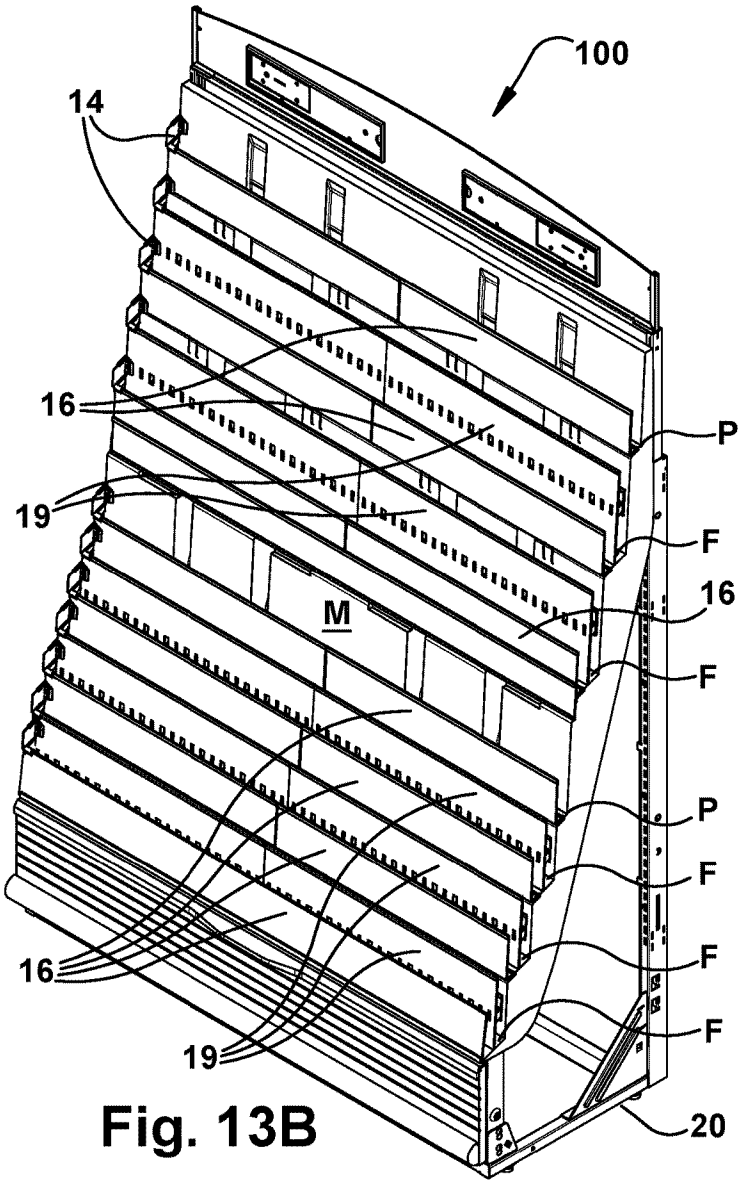
FIG. 13B is a perspective view of the greeting card display of FIG. 13A, with all flexible card rows in an open position.
Figure 13A:
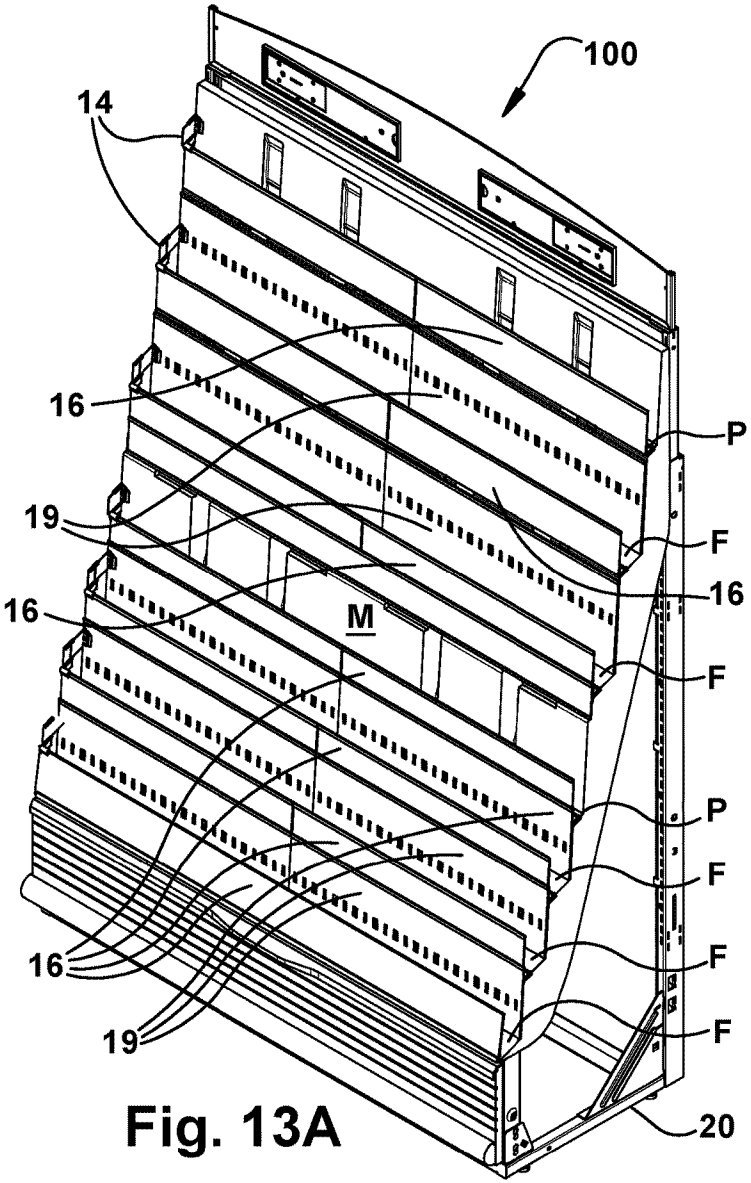
FIG. 13A is a perspective view of one embodiment of the greeting card display of the present invention, with all flexible card rows in a closed position.
Figure 14A:
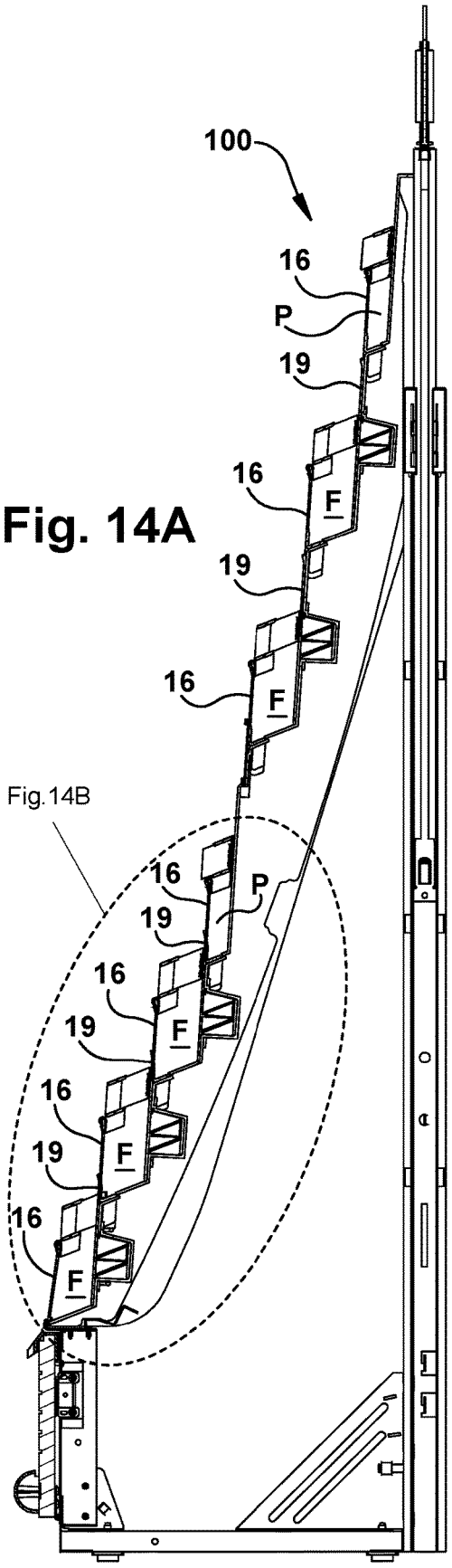
FIG. 14A is a side cross-sectional view of the greeting card display of FIG. 13A.

As mentioned above, a plurality of permanent card row shams 16 are attached to the card tier 12 via a snap-fit, to create the permanent card rows P. The permanent card rows P are made up of an angled portion 21 of the card tier 12, which serves as the floor or bottom of the permanent card row P, a vertical portion of the card tier, which serves as the back of the card tier and a permanent card row sham or cover 16 which serves as the front wall of the permanent card row P. The card tier 12 contains a plurality of slots or openings which accommodate insertion of the plurality of permanent shams or covers 16 which complete the permanent card rows P. In one embodiment, as shown in FIGS. 13A and 14A, there are seven (7) permanent card rows P on the card tier 12. Three (3) rows are contained in an upper section of the display (above the mid strip M) and four (4) rows are contained in a lower section of the display (below the mid strip M). The permanent card rows P are operative to hold and display a plurality of greeting cards inserted therein. The greeting cards in each row sit atop the angled portion of the card tier (the floor of the card row) 21 and between a flexible card row sham 18 or cover (back) and the inserted permanent card row sham or cover (front) 16. In the case of the very top permanent card row, the back surface of the card pocket would be a vertical surface of the card tier 12. In one embodiment, the permanent card row cover or sham 16 is made of transparent plastic so that the lower portion of plurality of greeting cards contained therein can be seen therethrough. Unlike the flexible card rows F, the permanent card rows P cannot be moved between open and closed positions but are static in an open position with a 2-inch depth between the back of the card row (vertical portion of the card tier 12) and the front of the card row (permanent card row sham or cover 16). Each 2-inch, permanent card row P can be divided, by the flexible card rows F, into two (2) 1-inch pockets.

Figure 17:
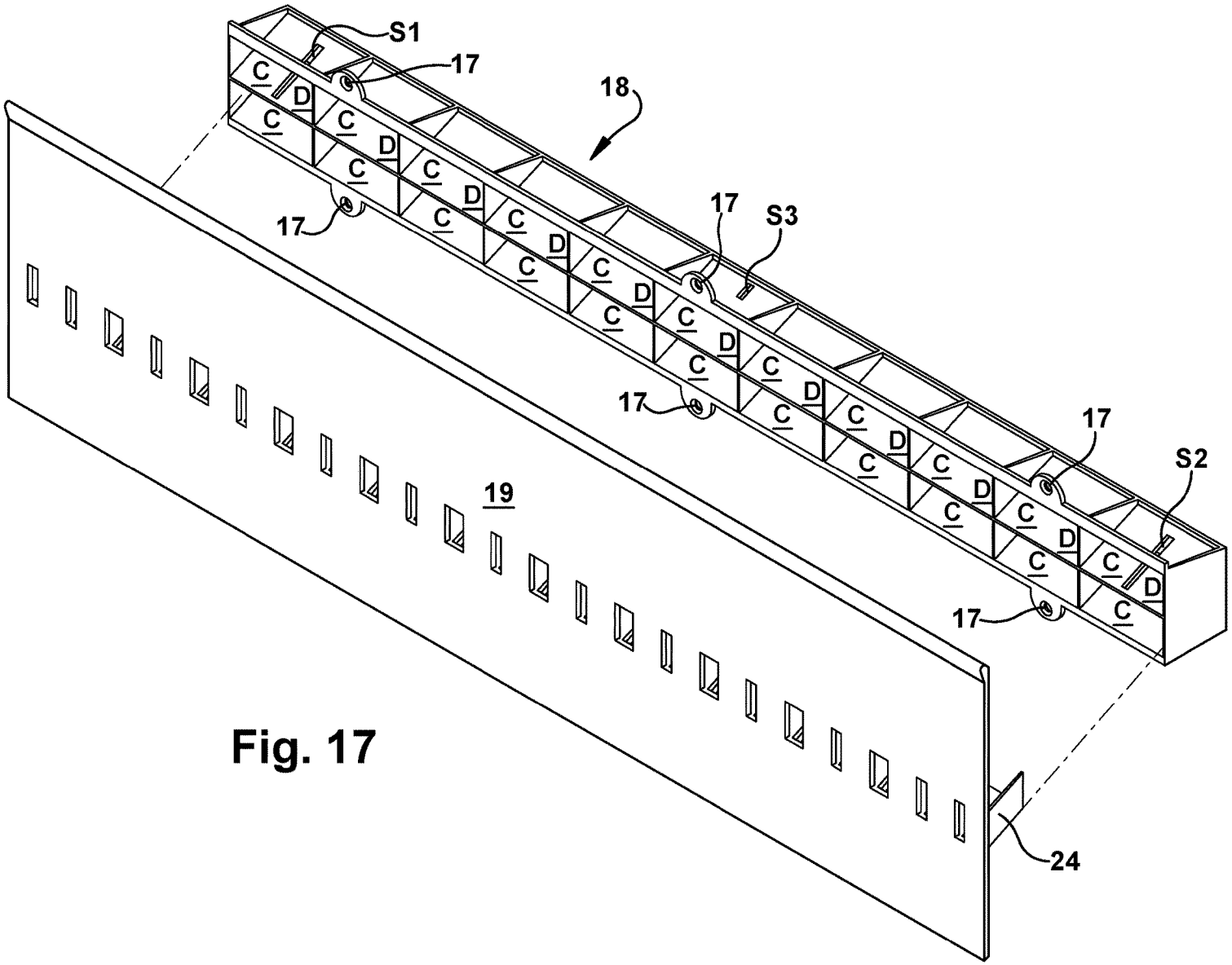
FIG. 17 is an exploded view of the tier insert and flexible card row sham.
Figure 18D:
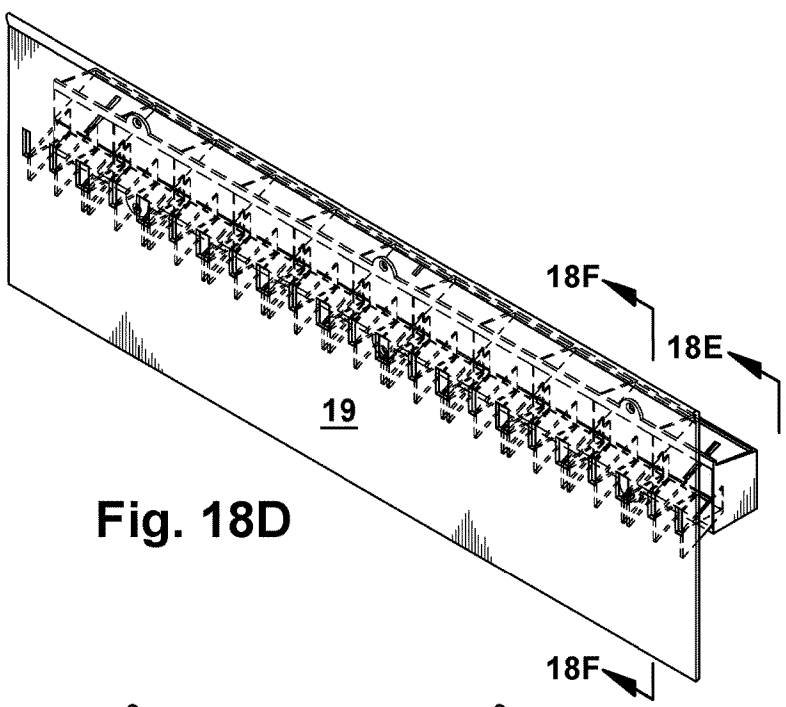
FIG. 18D is a perspective view of the tier insert with flexible sham partially attached thereto.
Figure 18F:
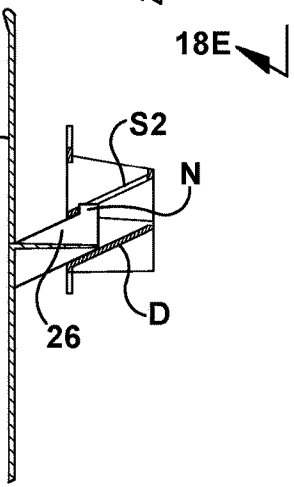
FIG. 18F is a cross-sectional view FIG. 18D.
Figure 18E:
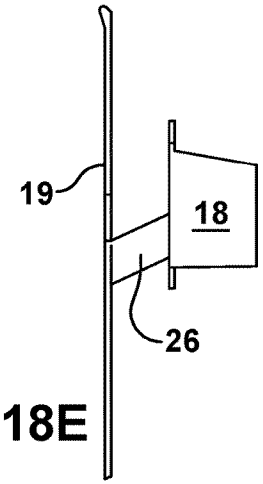
FIG. 18E is a side view of FIG. 18D.
Figure 18A:
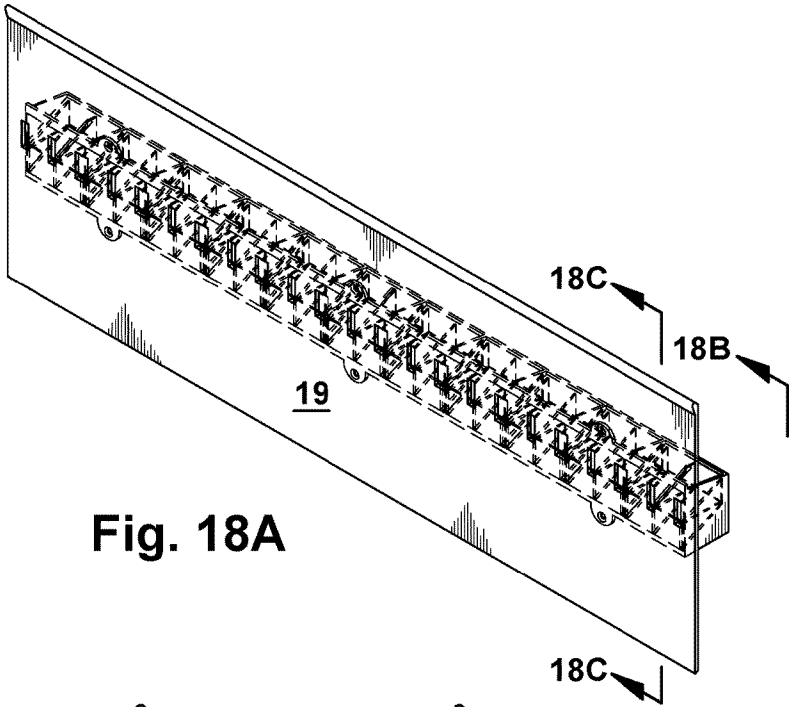
FIG. 18A is a perspective view of the tier insert with flexible sham attached thereto.
Figure 18C:
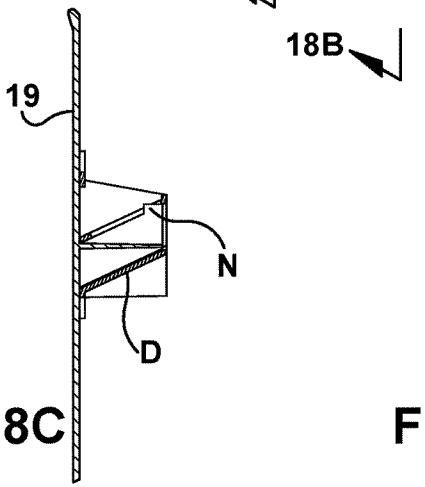
FIG. 18C is a cross-sectional view of FIG. 18A.
Figure 18B:
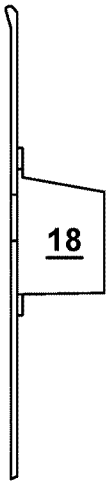
FIG. 18B is a side view of FIG. 18A.
Figure 19A:
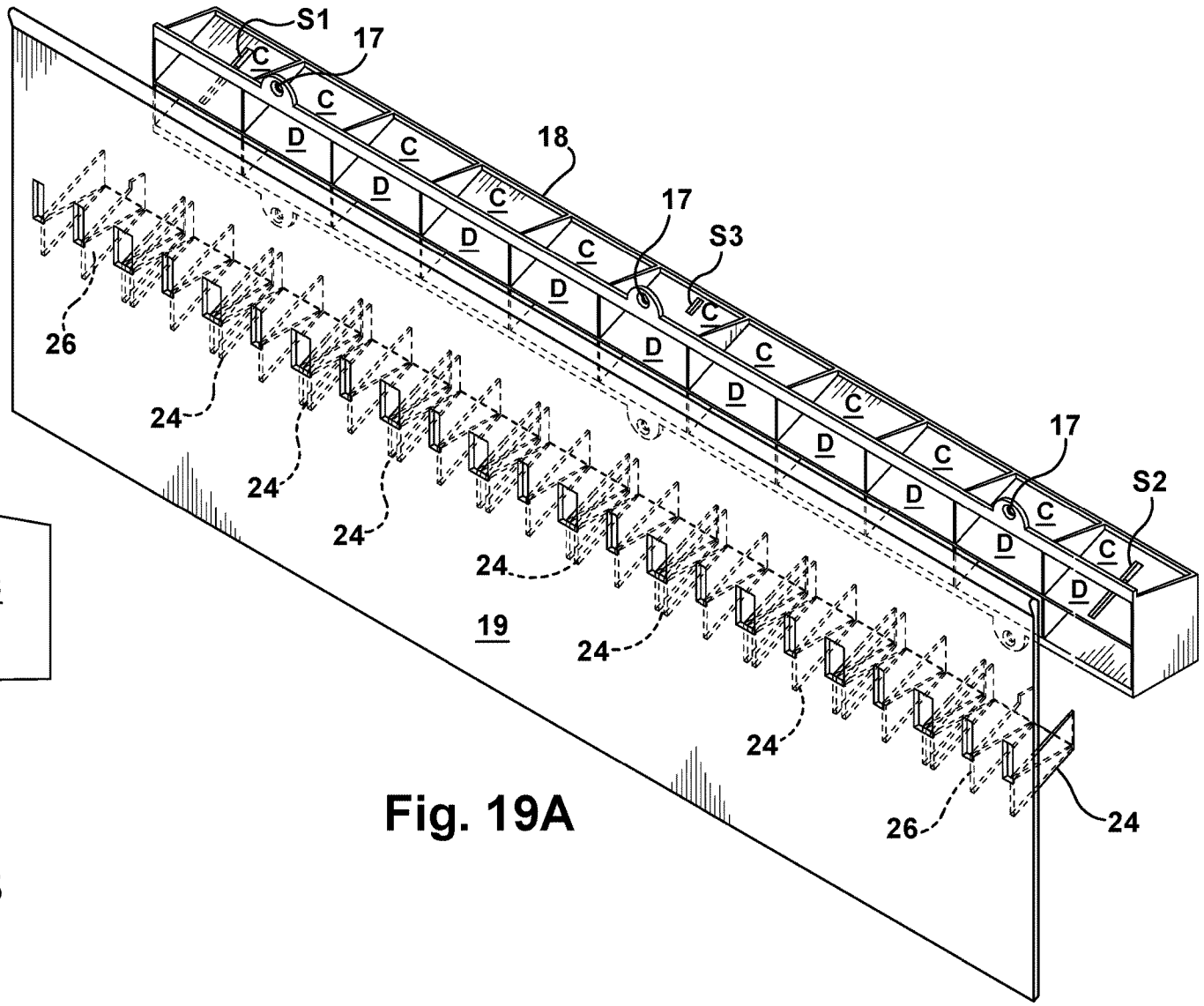
FIG. 19A is an exploded view of a tier insert and flexible card row sham.
Figure 19B:
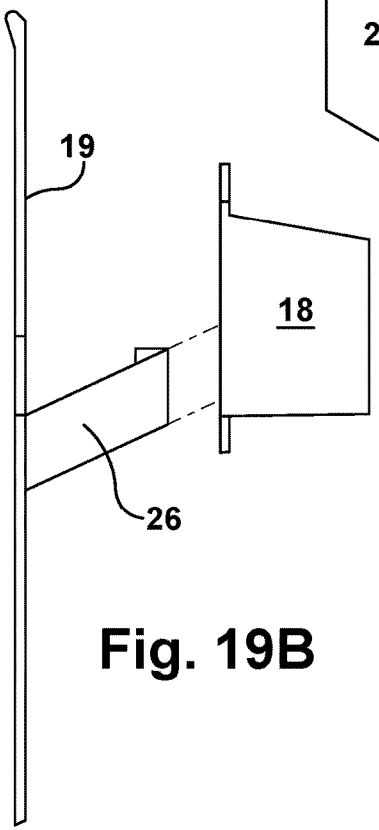
FIG. 19B is a side view of the tier insert and flexible card row sham of FIG. 19A.
Figure 20C:
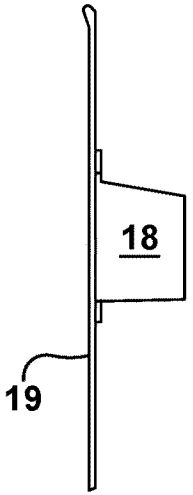
FIG. 20C is a side view of the tier insert and flexible card row sham of FIG. 18A.
Figure 20B:
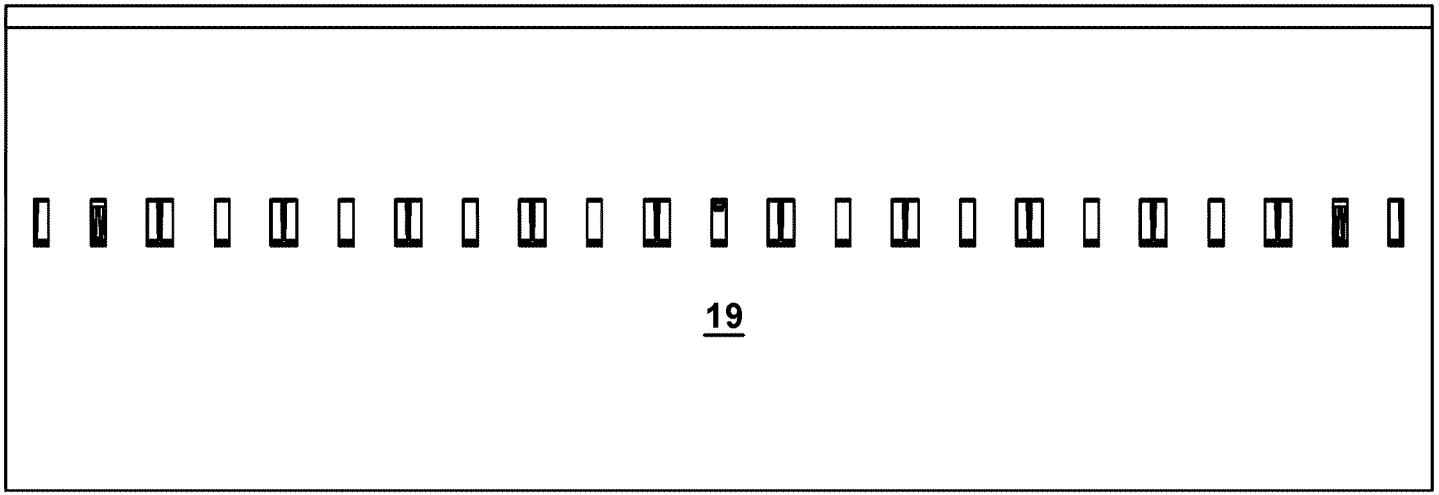
FIG. 20B is a front view of the tier insert and flexible card row sham of FIG. 18A
Figure 20A:
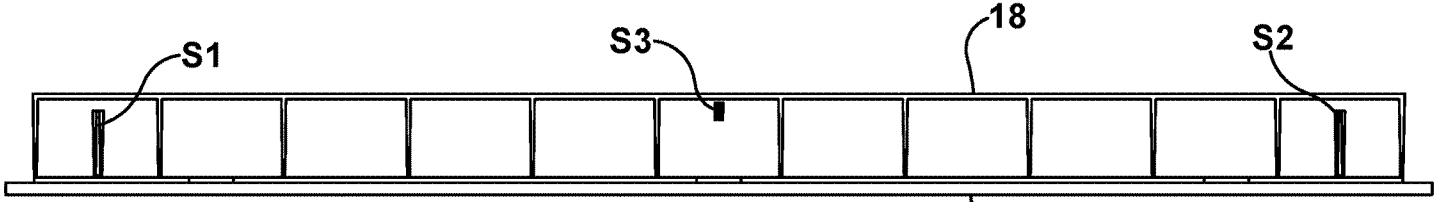
FIG. 20A is a top-down view of the tier insert and flexible card row sham of FIG. 18A.
Figure 21:
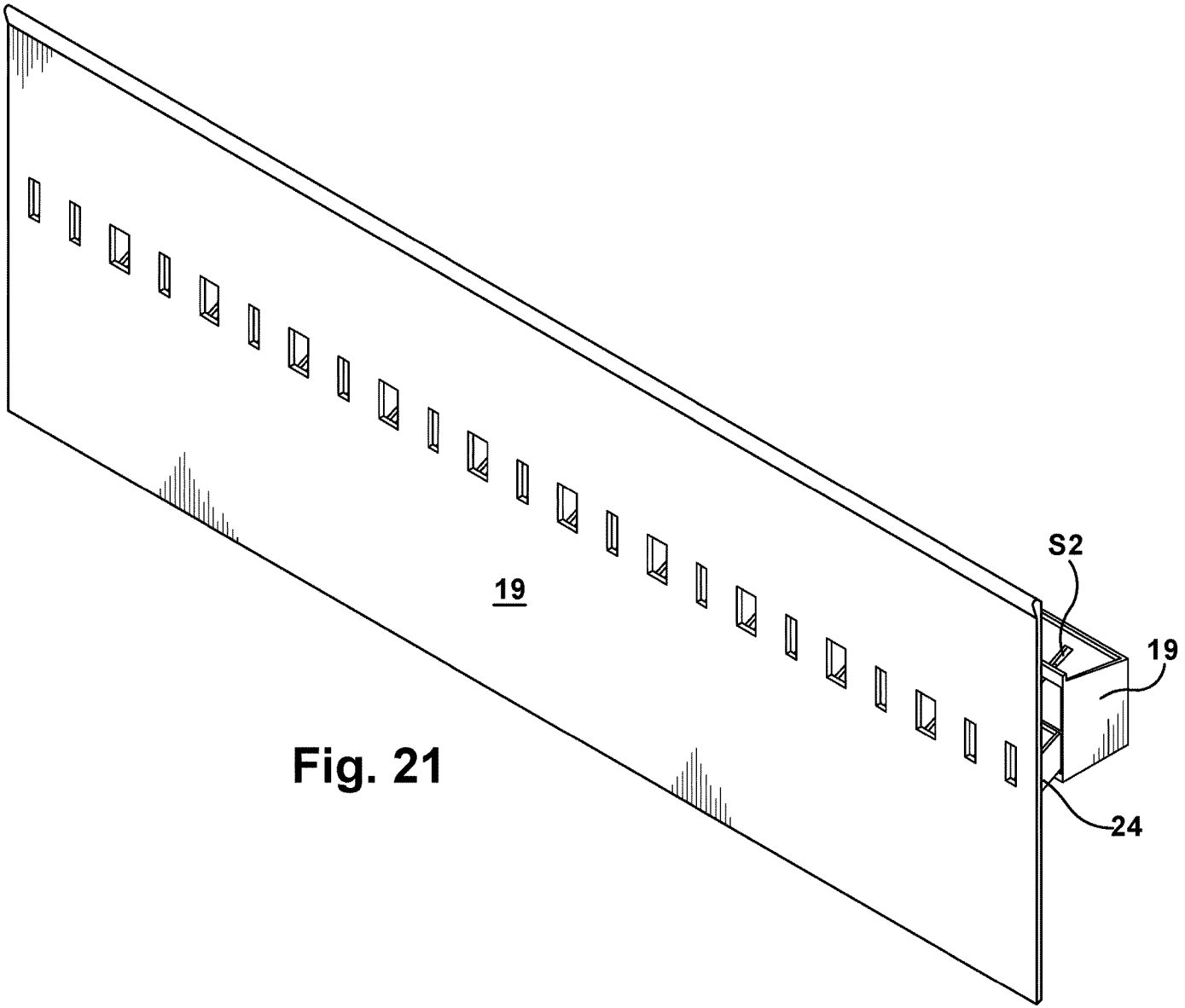
FIG. 21 is a perspective view of the tier insert and flexible card row sham of FIG. 18D.
Figure 22:
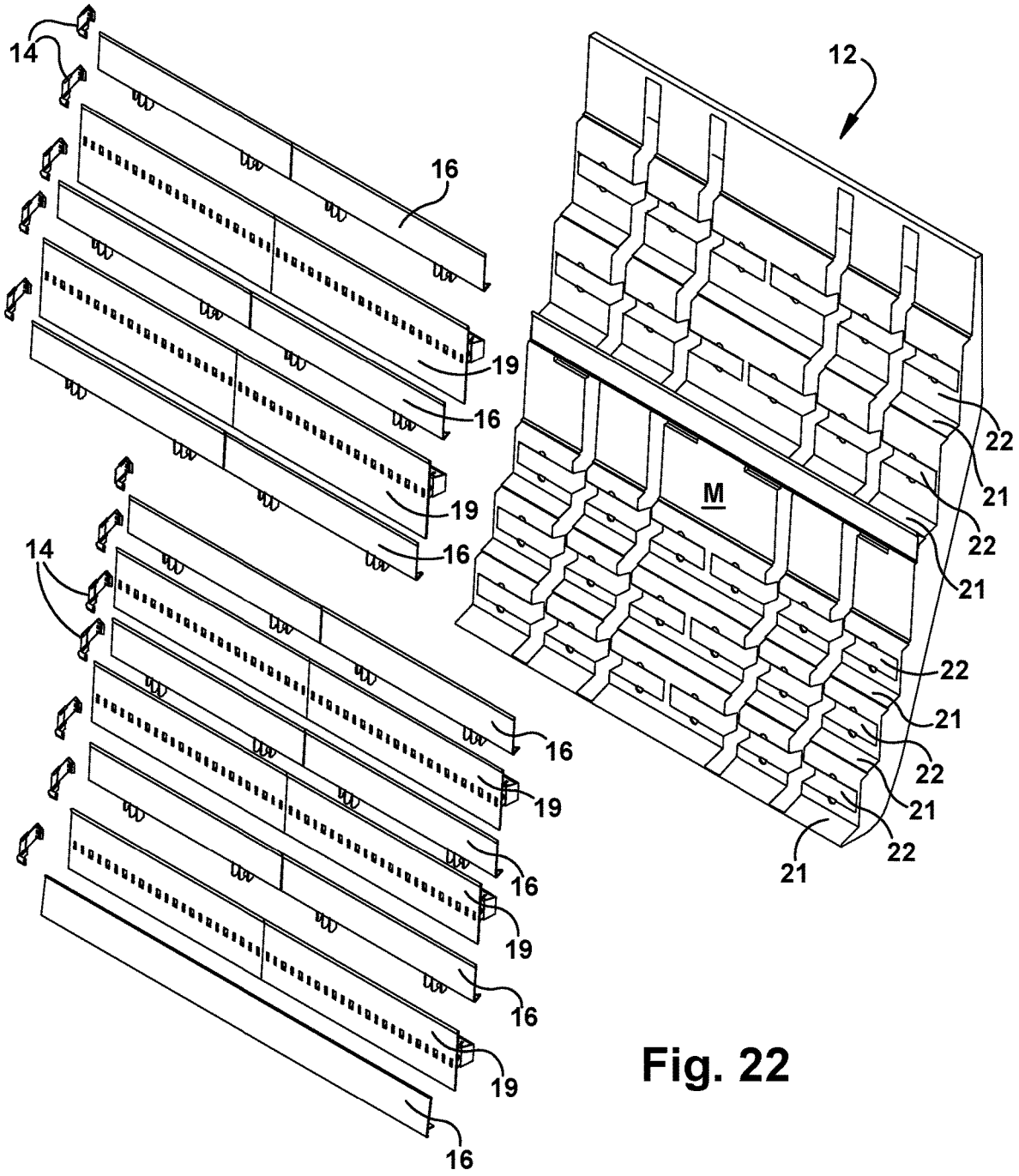
FIG. 22 is an exploded view of the greeting card tier, tier insert and flexible card row shams, and permanent card row shams.
Figure 23B:
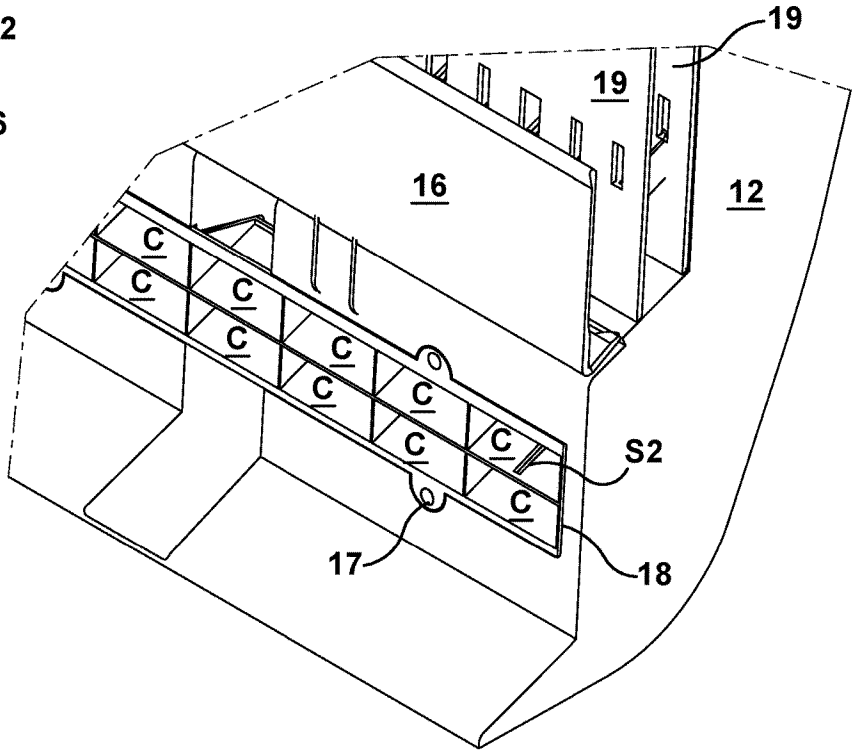
FIG. 23B is a perspective view of a lower portion of FIG. 23A.
Figure 23A:
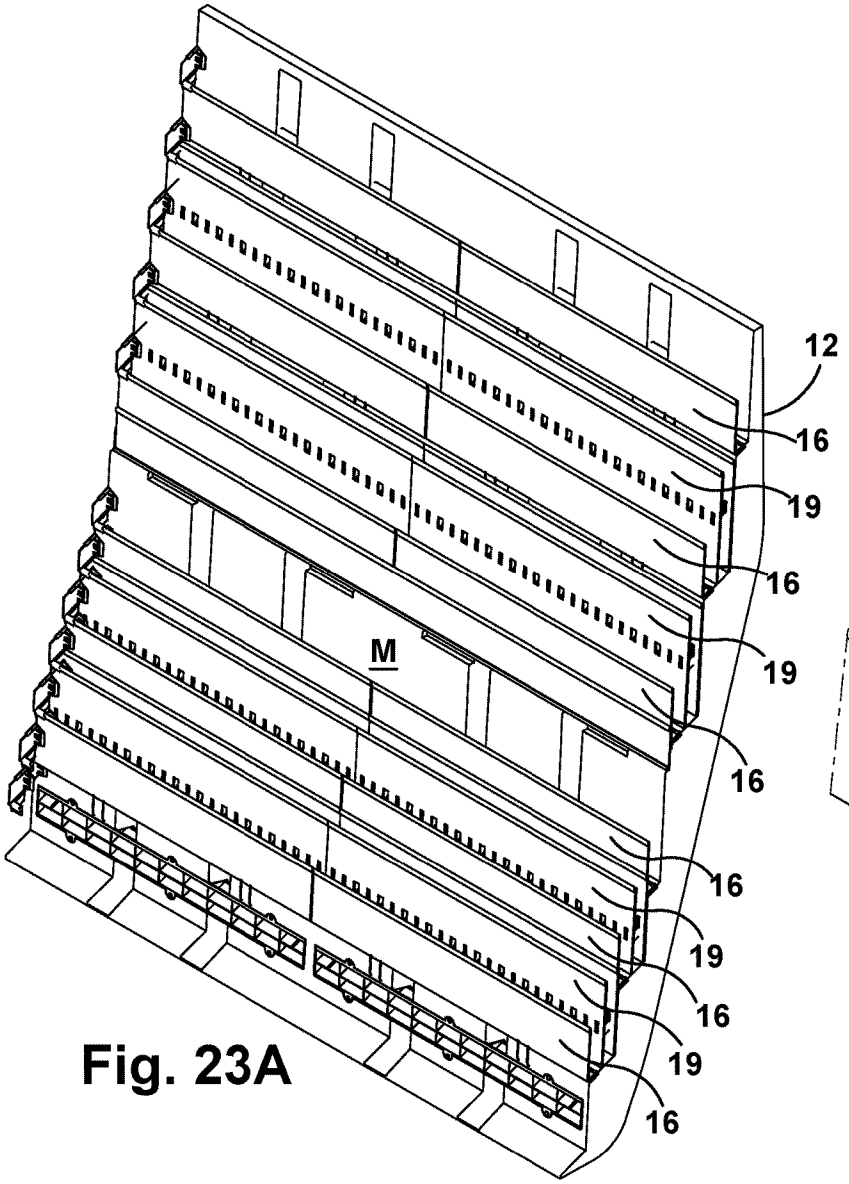
FIG. 23A is a perspective view of the assembled card tier, tier insert and flexible card row shams and permanent card row shams, with one flexible card row removed.

The plurality of tier inserts 18 are substantially rectangular injection molded pieces containing various compartments, as shown in FIGS. 17, 18A-F, 19A-B, 20A-C. Each tier insert 18 is inserted into one of the plurality of indented or depressed areas 22 (shown on FIG. 16) formed at various levels on the card tier 12 to accommodate each tier insert 18. It is then permanently attached thereto via sonic welding or pop rivet fastener. As can be seen in FIG. 17, there are three (3) openings 17 which extend upward from the top front edge of the tier insert 18 and three (3) openings 17 which extend downward from the bottom front edge of the tier insert 18. These six (6) openings 17 accommodate the insertion of a pop rivet therein to permanently attach the tier insert 18 to the card tier 12. Each tier insert 18 is an elongate substantially rectangular six-sided structure having five (5) closed sides and one (1) open side. When the tier insert 18 is inserted into the card tier 12, the open side is facing forward. The inside space within each tier insert is configured or apportioned into a plurality of smaller sections or compartments C generally forming two rows. A top row of compartments is aligned with and directly above a lower row of compartments. The divider D between the top and bottom rows of compartments C extends from the top back edge of the tier insert 18 and angles forward until it reaches the vertical midpoint between the top and bottom edges of each tier insert 18, making each compartment C in the top row substantially triangular shaped. In a one embodiment, there are eleven (11) compartments C in each the top and bottom rows. These compartments C accommodate the insertion of a plurality of fins or projections 24 which extend outward from and are perpendicular to each of the flexible card row shams or covers 19, as can be seen in FIGS. 18 and 19. The divider D between the top and bottom rows of the tier insert 18 contains a first slot, S1 located near the right edge, a second slot S2, located near the left edge and a smaller third slot S3 which is located at the horizontal midpoint of the divider, as shown in FIGS. 19 and 20. The slots S1, S2, S3 accommodate the insertion of the flexible cover or sham 19, enabling the flexible card row F to move between the open and closed positions.

Figure 15A:
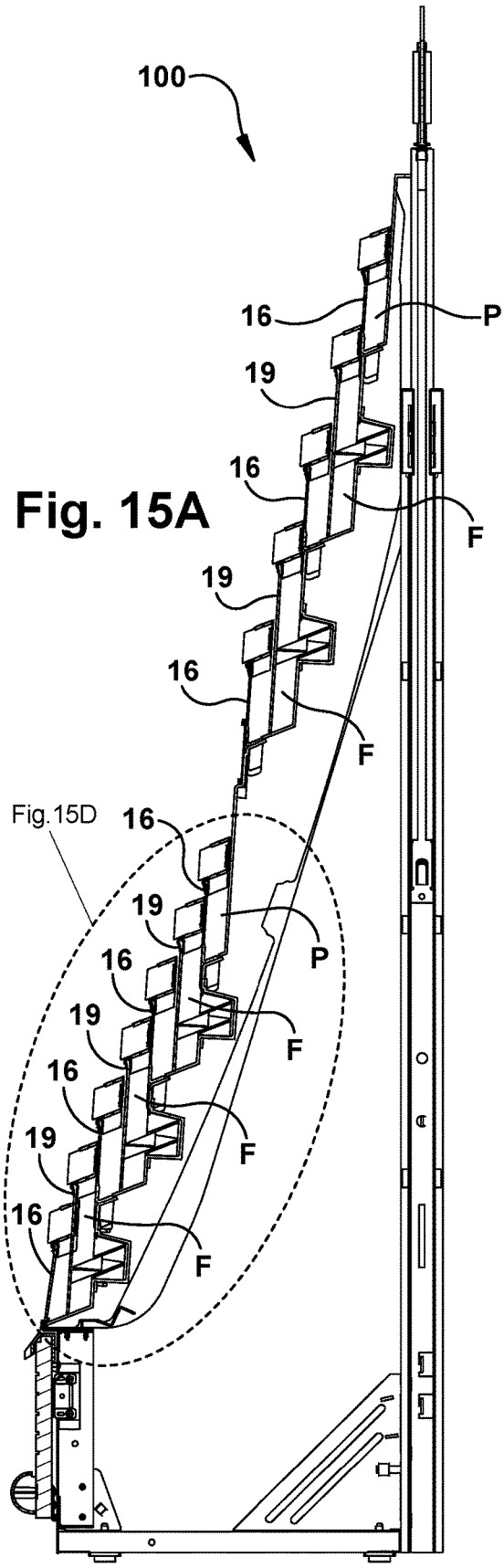
FIG. 15A is a side cross-sectional view of the greeting card display of FIG. 13B.
Figure 15B:
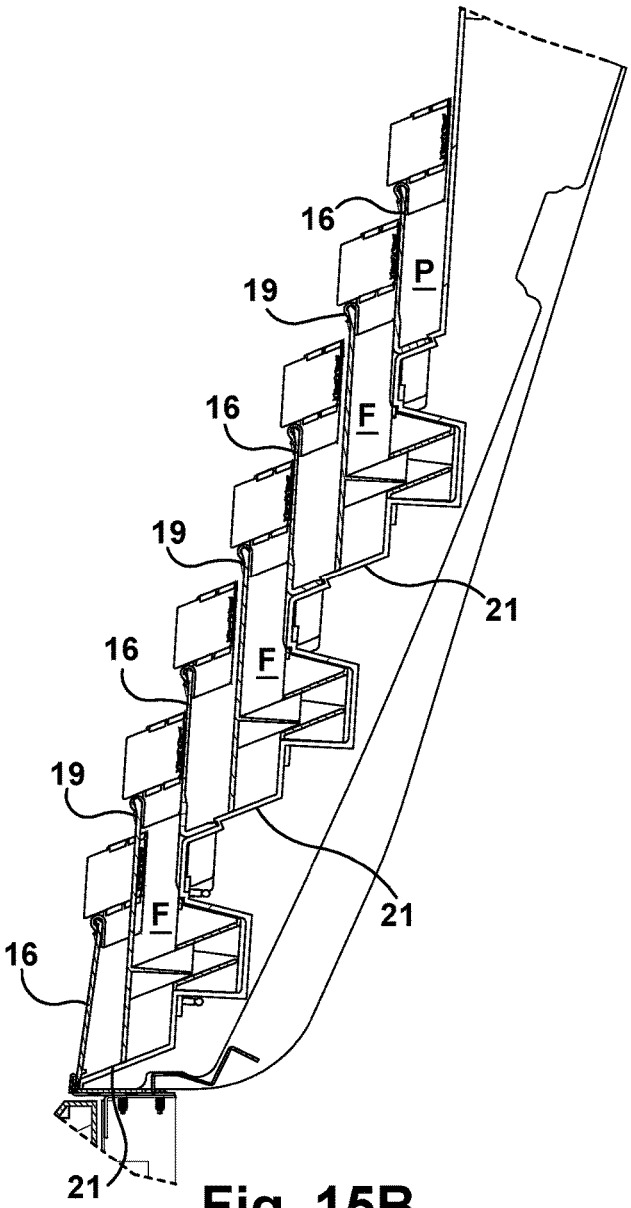
FIG. 15B is a cross-sectional view of a portion of FIG. 15A.

Each of the plurality of flexible card row shams or covers 19, shown clearly in FIGS. 17-22, include a vertical section which serves as the front wall of the flexible card row and a plurality of fins or projections 24 extending outward from and perpendicular to the rear surface of the vertical section. These fins or projections 24 are designed to fit within the plurality of compartments C inside the tier insert 18 when the flexible card row shams or covers 19 are attached to the tier insert 18. Each of the flexible card row shams or covers 19 also contain two vertical returns 26 located at opposing ends thereof. When the flexible card row F is in a closed position, the fins or projections 24 of the flexible card row shams or covers 19 are inserted into the plurality of compartments C within the tier insert 18 and the two (2) vertical returns 26 are inserted into the first and second slots S1, S2 located at opposing ends of the tier insert 18. The angle and configuration at which the two (2) vertical returns 26 are inserted into the two (2) slots S1, S2 located on the tier insert 18 retain the pocket in the closed position wherein it is completely flush with the open side of the tier insert. To move the pocket into an open position, the flexible card row sham or cover 19 is pulled outward away from the tier insert 18. A notch N located on each of the two (2) vertical returns 26, as shown in FIGS. 18C, 18F and 19 catches on the front or forward-most edge of the each of the two (2) slots S1, S2 located on the tier insert 18, thereby retaining the flexible card row sham or covers 19 in the open position. When a flexible card row F is extended out in the open position, the fins or projections 24 on the rear surface of each flexible card row sham or cover 19 are removed from within the tier insert 18 and serve as the floor or bottom of the card row atop which a plurality of greeting cards inserted therein would rest, as can be seen in FIG. 15D. The fins or projections 24 elevate the greeting cards contained on the flexible card row F so that a larger portion of said cards can be seen above greeting cards placed into the permanent card row P located directly below. The permanent card row sham or cover 16 located directly above the flexible card row F serves as the back surface of the flexible card row F and the flexible card row sham 19 or cover serves as the front wall of the flexible card row F.

The plurality of card divider clips 14 are used to divide each card row into a plurality of card pockets. Each divider clip 14 contains two sections, an attachment portion and an adjustable slider portion. The attachment portion contains an inverted u-shaped channel which is operation to be placed over the front wall of a card row. The inverted u-shaped channel is attached along a right edge thereof to a vertical section (approximately 1-inch wide) having channels on the inside surface thereof to accommodate the adjustable slider portion. The adjustable slider portion snaps into the channels located on the inside surface of the vertical section and is slidable in and out with respect thereto. The adjustable slider portion has a substantially L-shaped form. The divider clip 14 is operable to move between a first position wherein it has an approximately 1-inch depth (wherein the adjustable slider portion is contained within the channels on the attachment portion) and a second position (wherein it is extended out of the channels approximately 1-inch), wherein the entire clip has an approximate 2-inch depth. The card divider clip 14 does not operate to hold the adjustable card pockets in the open position—the sole purpose of the card divider clip 24 is to divide the card rows into smaller card pockets. The card divider clips 14 can be placed at various intervals along a card row depending on the width of the card pockets required.

Figure 14B:
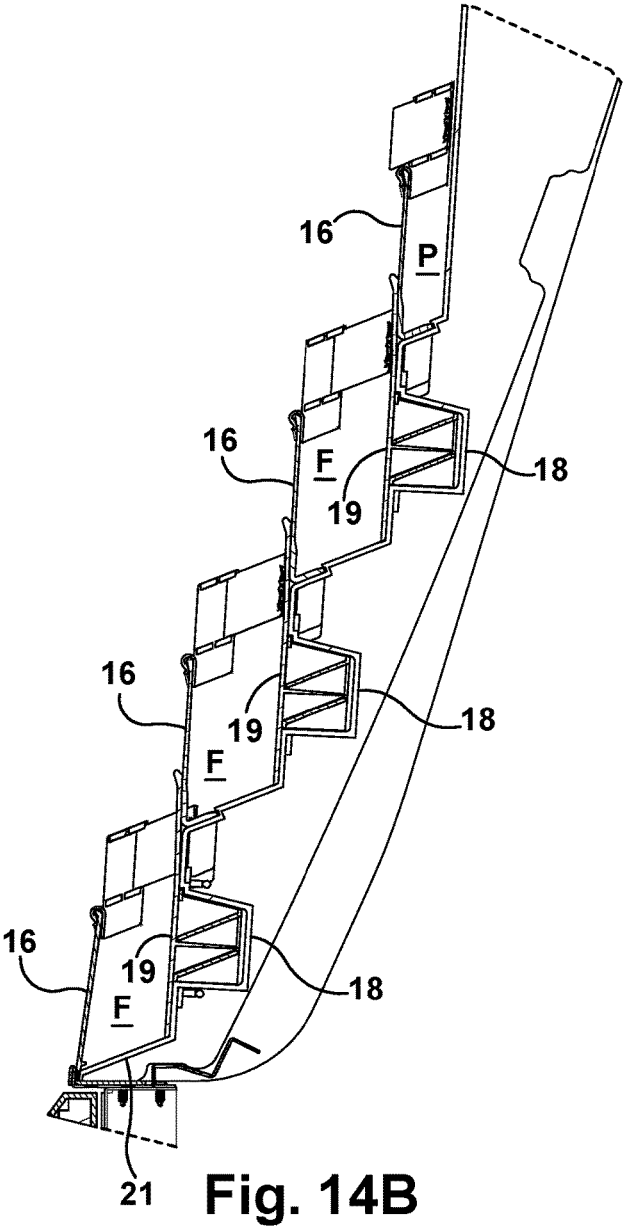
FIG. 14B is a cross-sectional view of a portion of FIG. 14A.

In a one embodiment, the greeting card display with flexible row count card tier 100 has an upper section and a lower section which are divided by a mid-strip channel M. The upper and lower sections and the mid-strip channel M are contiguous. The upper section contains three (3) permanent card rows and two (2) flexible card rows. The lower section contains four (4) permanent card rows and three (3) flexible card rows. When all of the flexible card rows are in the closed position, as shown in FIGS. 13A and 14A each of the permanent card rows have a 2-inch depth. When all of the flexible card rows are in the open position, as shown in FIGS. 13B and 14B, both the flexible card row sham or cover 19 of the flexible card row F is pushed inward into the tier insert 18 (which is inserted into the card tier 12) until portions of the flexible card row sham or cover 19 of the flexible card row F are in direct contact with the front wall (sham or cover) 16 of the card pocket directly above the now-closed flexible card row F. As explained above, the flexible card row sham or cover 19 contains two (2) vertical returns 26 on opposing sides thereof. Insertion of the two (2) vertical returns 26 into the two (2) slots S1, S2 located on opposing sides of the tier insert 18 enables the flexible card row sham or cover 19 to be retained in a closed position. To open a closed flexible card row F, the flexible card row sham or cover 19 is pulled outward and away from the front wall (sham or cover) 16 of the card pocket directly thereabove. Also mentioned above, a notch N located on each of the two (2) vertical returns 26 on the flexible card row sham or cover catches 19 on the front or forward most edge of the each of the two (2) slots S1, S2 located on tier insert 18. The flexible card row F is operative to move or open approximately 1-inch away from the closed position, thereby splitting the previously single, 2-inch depth card pocket into two (2) 1-inch depth card pockets.

Second Embodiment

In a second embodiment of the present disclosure and related inventions, shown in FIGS. 1 through 12, the flexible row count card tier 200 includes a card tier 30, a plurality of permanent card rows P, and a plurality of flexible card rows F. A plurality of card divider clips 32 may be inserted over each of the plurality of permanent and/or flexible card rows, along the width of each row to divide the row into individual card pockets into which a group of greeting cards may be inserted.

Figure 2:
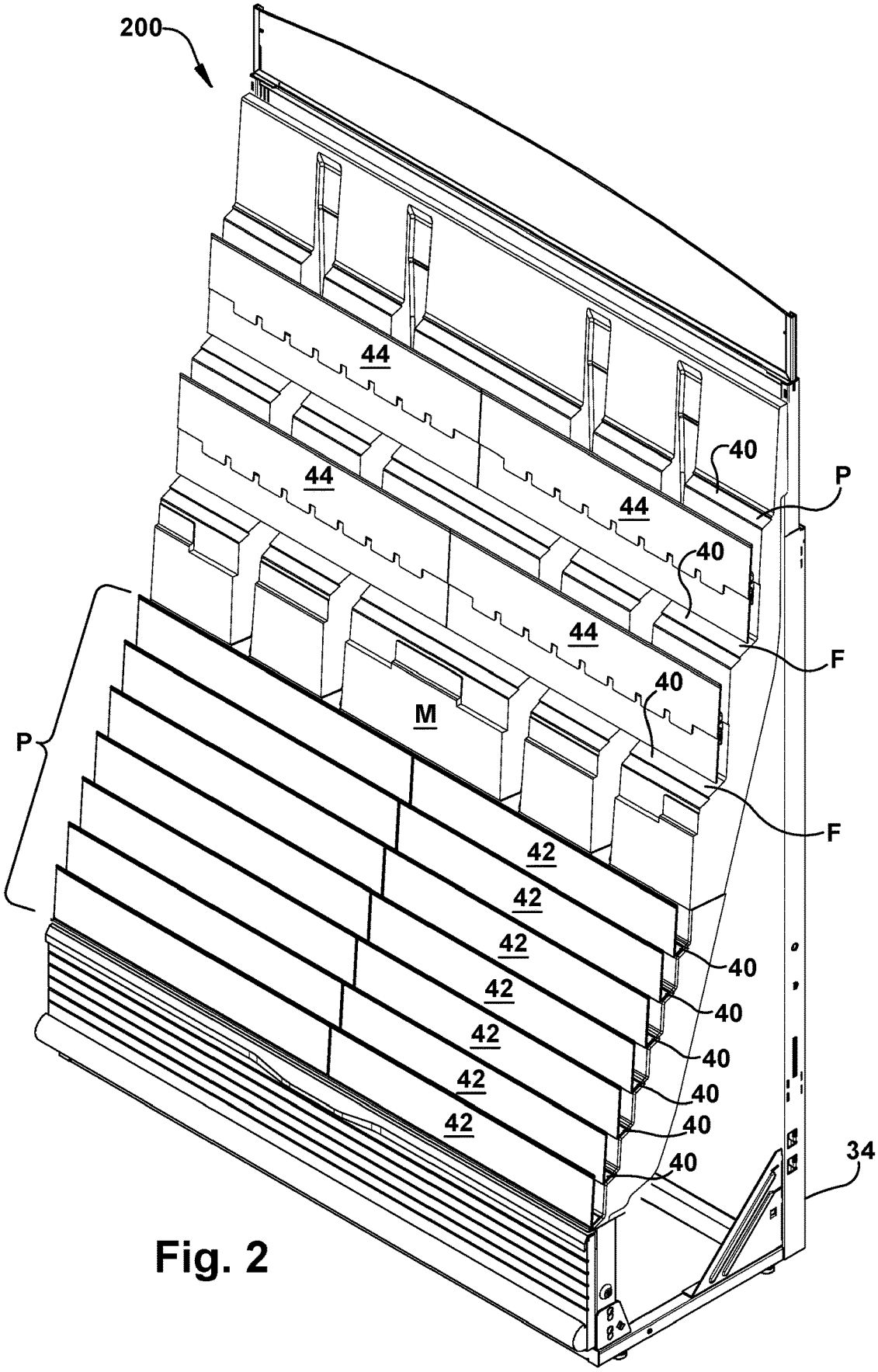
FIG. 2 is a perspective view of the greeting card display of FIG. 1, with flexible rows in an open position.
Figure 3:
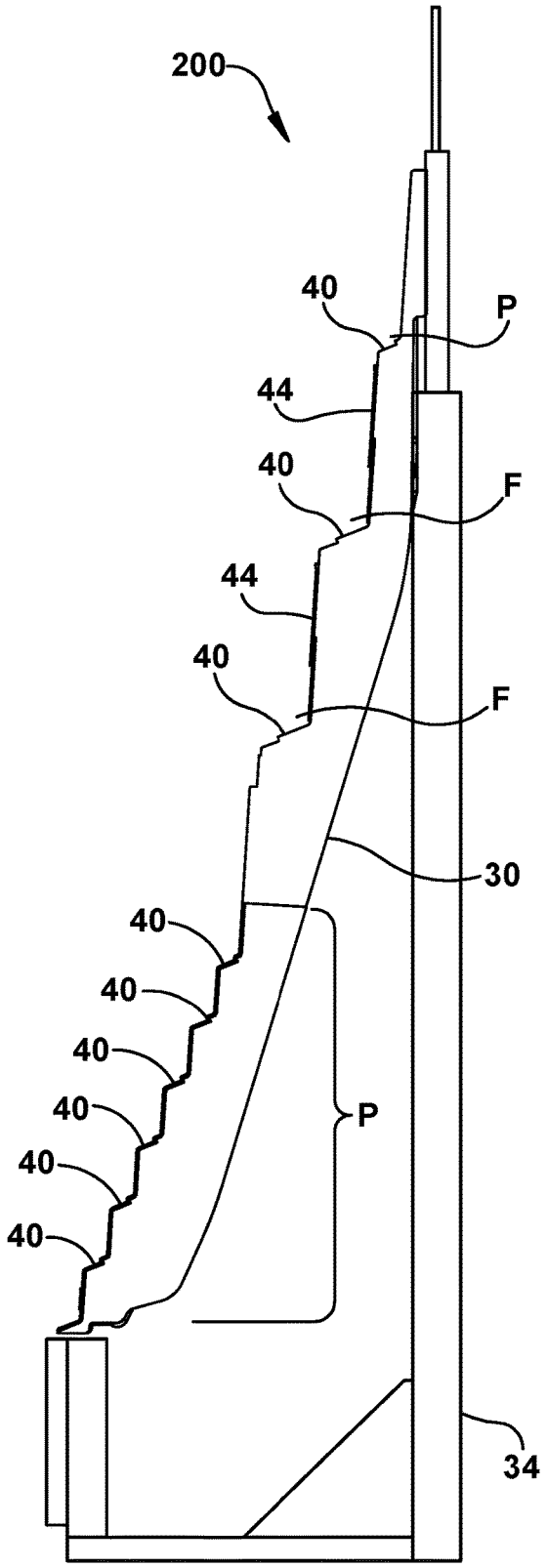
FIG. 3 is a side view of the greeting card display of FIG. 1.
Figure 4:
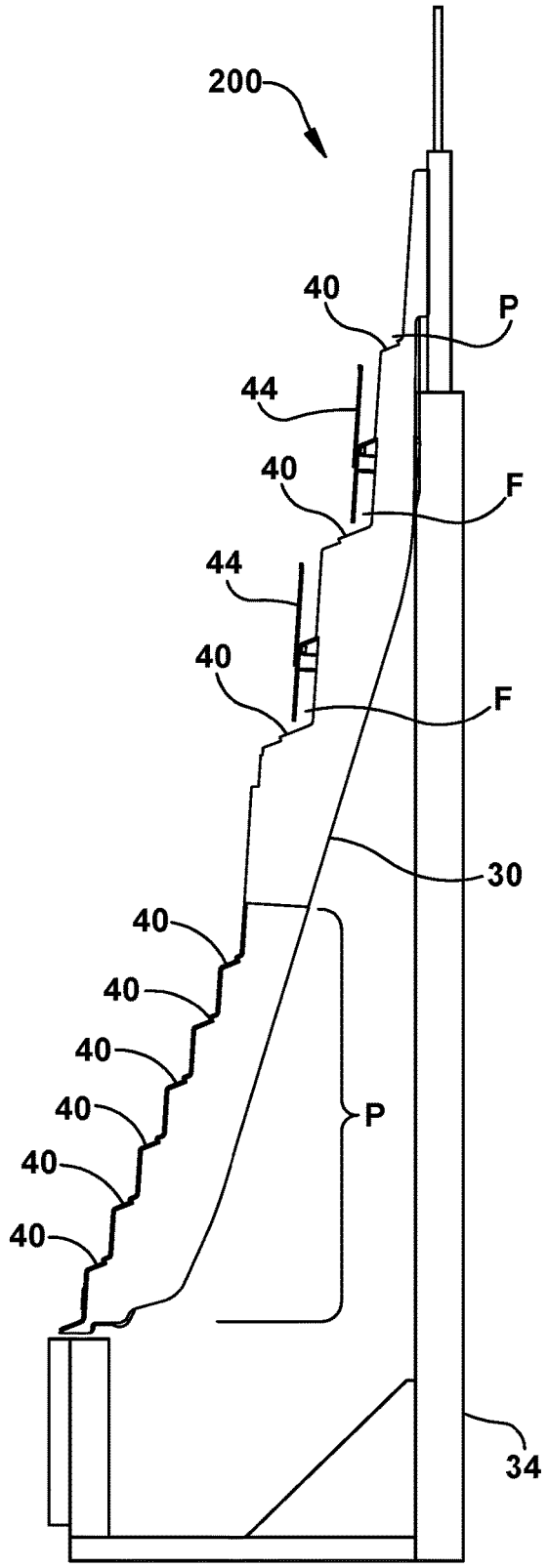
FIG. 4 is a side view of the greeting card display of FIG. 2.
Figure 12:
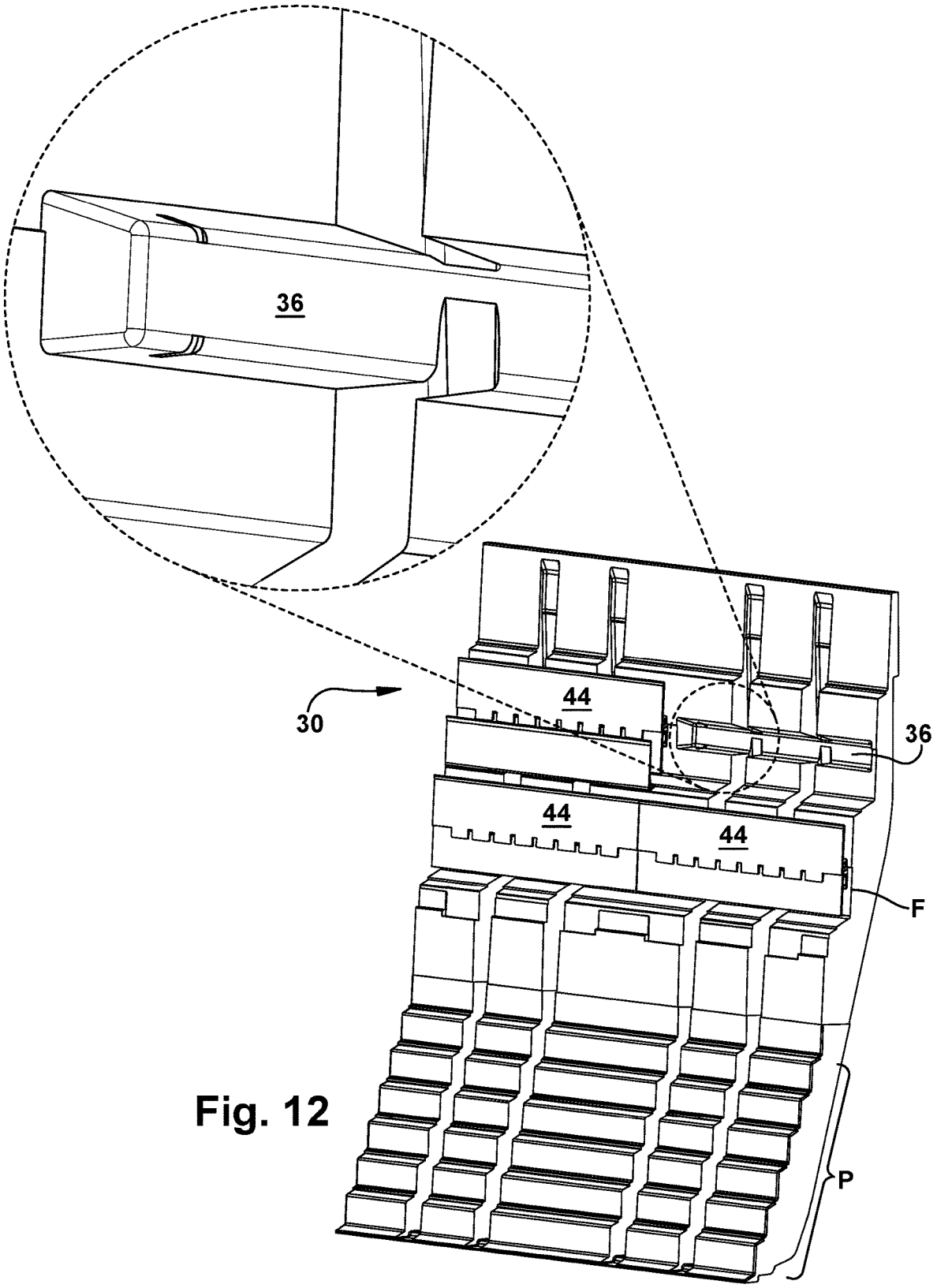
FIG. 12 is a perspective view of the card tier with a flexible card tier removed.

The card tier 30, shown in FIG. 12, may be vacuum formed from an extrudable plastic sheet. In other embodiments, the card tier 30 can be made of other materials. The card tier 30 can be attached to a display module 34 (as shown in FIGS. 1 and 2) which, for example, may be made up of a stand or base which provides a foundation for the card tier 30 for placement on a retail floor. The display module 34 may contain an arrangement of horizontal and vertical members extending upward from the stand or base to create a substantially planar, upright back support onto which the card tier 30 is attached. The card tier 30 contains a plurality of indented or depressed areas 36 which are formed to accommodate insertion of the tier inserts 38. These indented or depressed areas 36 may contain one or more slots thereon to accommodate attachment of the plurality of card tier inserts 38. The card tier 30 may also contain a plurality of slots or openings thereon to accommodate a snap-fit of the plurality of permanent card rows and a section located mid-height for the attachment of a mid-strip channel M. The card tier 30 contains a plurality of tiers or steps, arranged in a downward cascading manner wherein beginning with the uppermost row, each successive tier or step projects downward and outward from each preceding step, with each row being at a lower elevation and a position slightly in front of the row directly above. Each substantially horizontal step or section serves as the floor 40 of each of the plurality of permanent card rows which supports a plurality of greeting cards placed thereon. In one embodiment, the card tier 30 is approximately 24-inches wide, although in other embodiments, the card tier 30 may have a width dimension which is shorter or longer than 24-inches.

A plurality of permanent card row shams or covers 42 are attached to the card tier 30 to form, a permanent card row P. Each permanent card row P is made up of an angled portion 40 of the card tier 30, which serves as the floor or bottom of the permanent card row P, a vertical portion of the card tier 30, which serves as the back of the permanent card row P and a permanent sham or cover 42 which serves as the front wall of the permanent card row P. Each of the permanent card row shams or covers 42 contain one or more fins, projections, returns or other outwardly projected portion which mates with one or more slots or openings on the card tier to create a snap-fit attachment of the permanent card row shams or covers 42 with the card tier 30. In one embodiment, there are ten (10) permanent card rows P attached to the card tier 30. Three (3) rows are contained in an upper section of the display (above the mid-strip M) and seven (7) rows are located in a lower section of the display (below the mid-strip M). The permanent card rows P are operative to hold and display a plurality of greeting cards inserted therein. The greeting cards in each row sit atop the angled portion 40 of the card tier 30 (the floor of the permanent card row P) and between a flexible card row sham or cover 44 (back wall) and the inserted permanent card row cover or sham (front wall) 42. In the case of the very top permanent card row, the back surface of the card pocket would be a vertical surface of the card tier 30. In one embodiment, the permanent card row cover or sham 42 is made of a transparent material so that the lower portion of and greeting cards contained therein can be seen therethrough. Unlike the flexible card rows F, the permanent card rows P cannot be moved between open and closed positions but are static in an open position with a 2-inch depth between the back of the card row and the front of the card row. In one embodiment, shown in FIGS. 1 and 2, two (2) of the three (3) permanent card rows P contained above the mid-strip panel M have a 2-inch depth and are operative to be divided, by the flexible card rows F, into two (2) 1-inch card rows. The remaining permanent card rows (one (1) above the mid strip M and seven (7) below the mid strip M) are 1-inch card rows.

Figure 6:
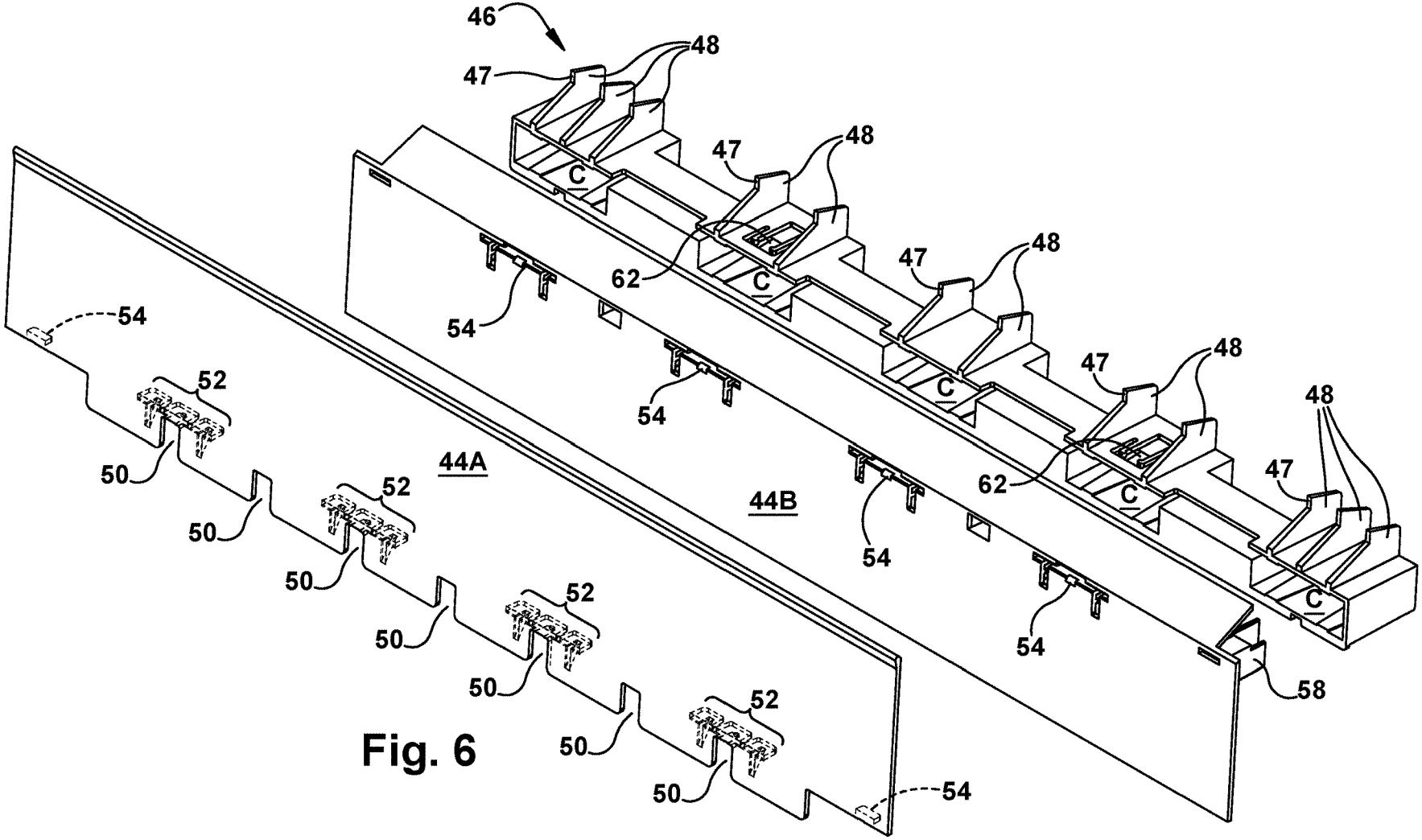
FIG. 6 is an exploded view of a card tier insert and flexible card row sham.
Figure 8:
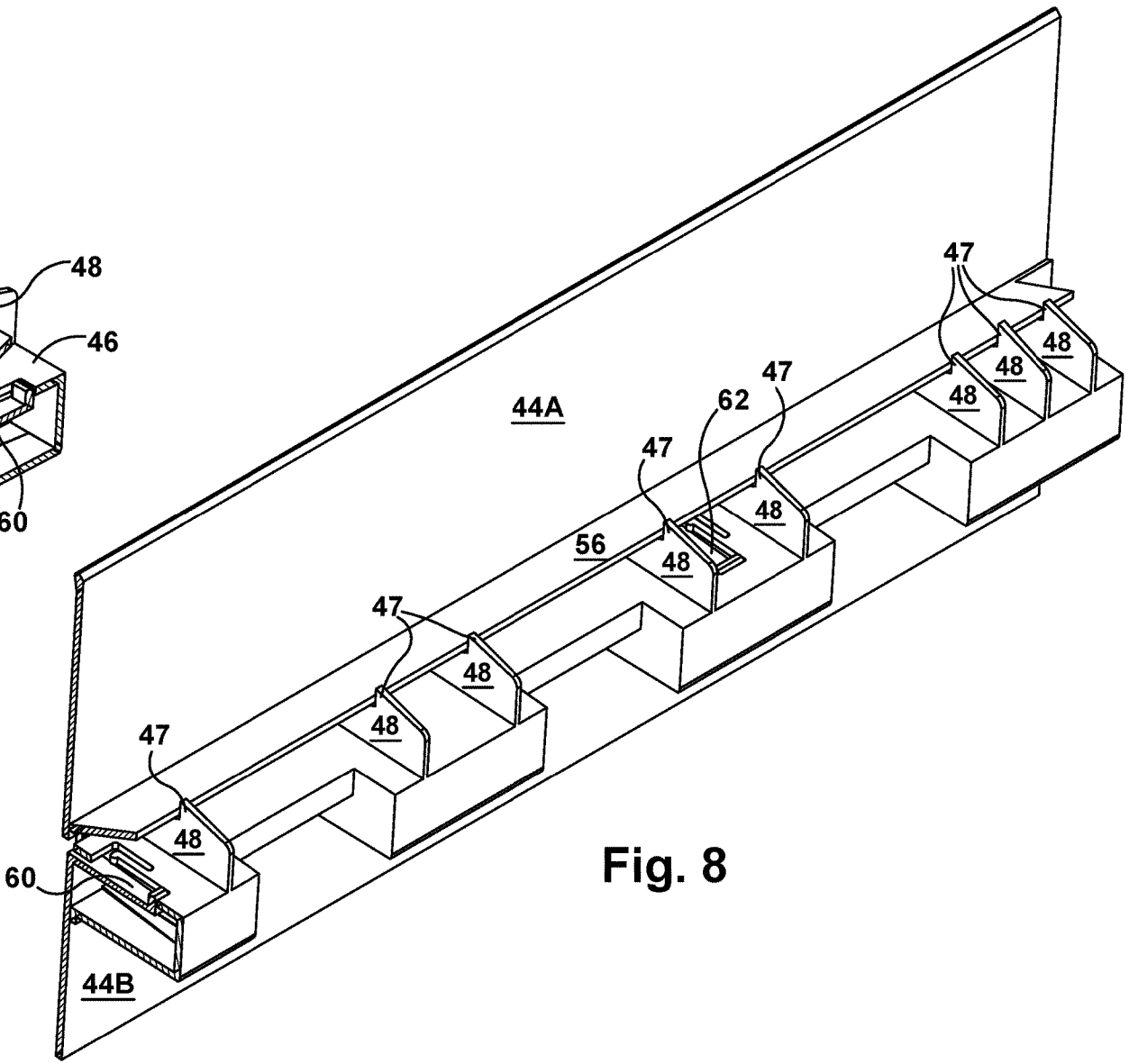
FIG. 8 is a rear perspective view of a card tier insert and flexible card row sham.
Figure 10:
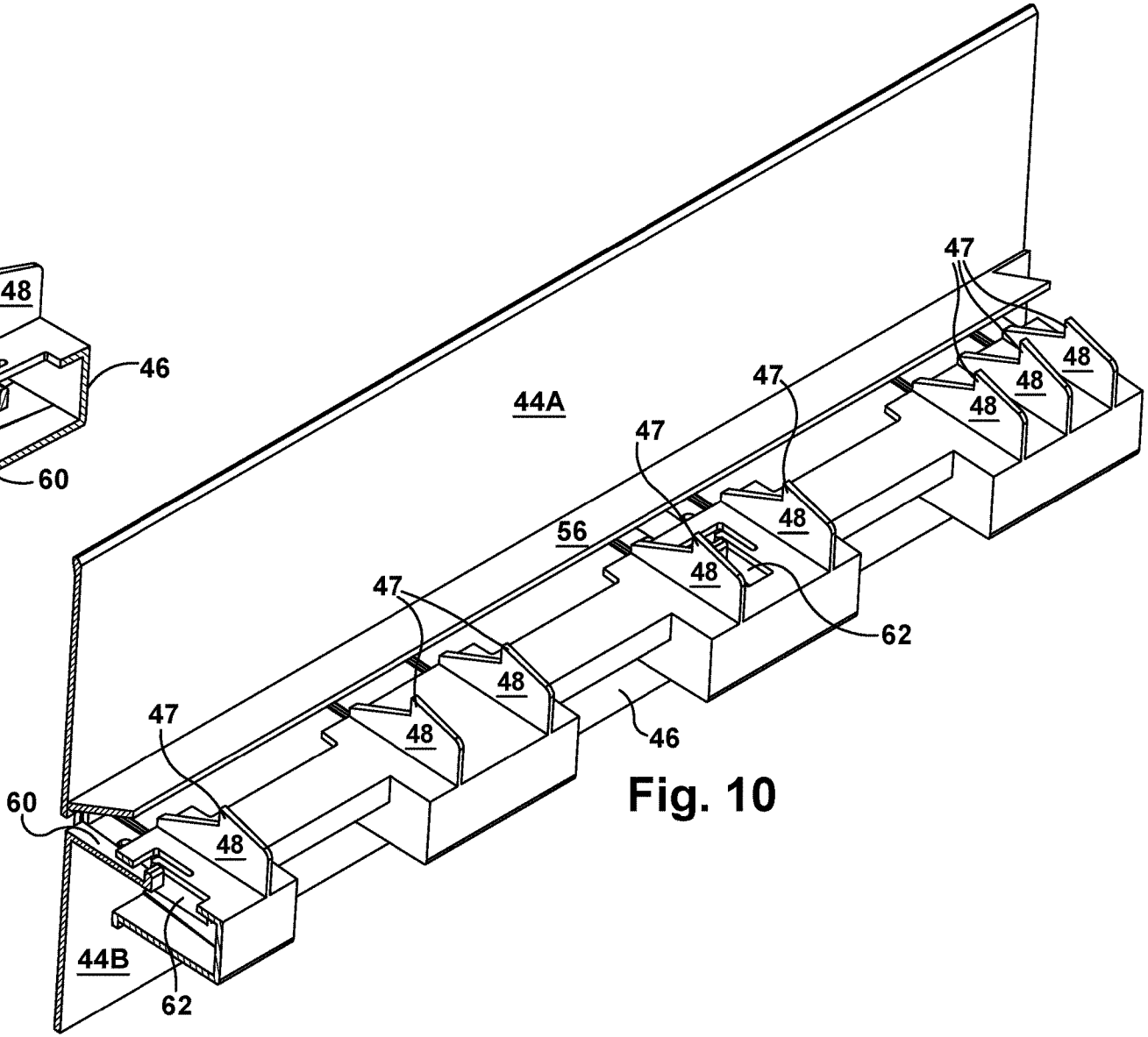
FIG. 10 is a rear perspective view of a tier insert and flexible card row sham.

The plurality of tier inserts 46 are substantially rectangular elements containing a plurality of compartments or cavities, as shown in FIGS. 6, 8 and 10. Each tier insert 46 is inserted into one of the plurality of indented or depressed areas 36 formed at various levels on the card tier 30, shown in FIG. 12, to accommodate attachment of the flexible card rows F to the card tier 30. In one embodiment, each card tier insert 46 is a 6-sided structure having a top side, a bottom side opposite the top side, a right side, a left side opposite the right side, a front side and a back side opposite the front side. Five (5) of these sides are closed sides and one (1), the front side, is an open side. The tier insert 46 is inserted into the card tier 30, the open side is facing forward such that the one (1) open side can be accessed to insert a flexible card row therein. A plurality of fins or projections 48 extend upward from the top surface of each tier insert 46. These fins or projections 48 contain an angled portion and a catch 47. When a tier insert 46 is attached to the card tier 30, the catch portion 47 of each of the fins or projections 48 on the top surface of tier insert 46 is inserted into one of the plurality of slots contained on the inside of one of the plurality of indented or depressed areas 36 on the card tier 30 to maintain secure attachment of each tier insert 46 to the card tier 30. In one embodiment, as shown in FIG. 6, each card tier insert 46 contains a total of twelve (12) fins or projections 48 extending upward from a top surface of each tier insert 46. A group of three fins or projections 48 are located at each distal end of the card tier insert with three (3) groups of two (2) fins or projections 48 spaced between the distal ends of the card tier insert 46. In one embodiment, each card tier insert 46 contains five (5) substantially rectangular compartments C therein. These five (5) compartments C are evenly spaced along the card tier insert 46 from the right to the left sides. Two (2) of the five (5) compartments C contain a rectangular aperture or opening 49 on an upper surface thereof. These apertures or openings 49 are provided to facilitate attachment of the flexible card row shams 44 to the card tier insert 46 (to form a flexible card row F) and also allow for the secure movement of the flexible card row shams 44 between open and closed positions. Each of the plurality of card tier inserts 46 may additionally contain any number of slots, apertures, tabs, catches or projections which facilitate insertion of the card tier insert 46 into the card tier 30 and also facilitate acceptance of the flexible card row shams 44 inserted therein.

Figure 5:
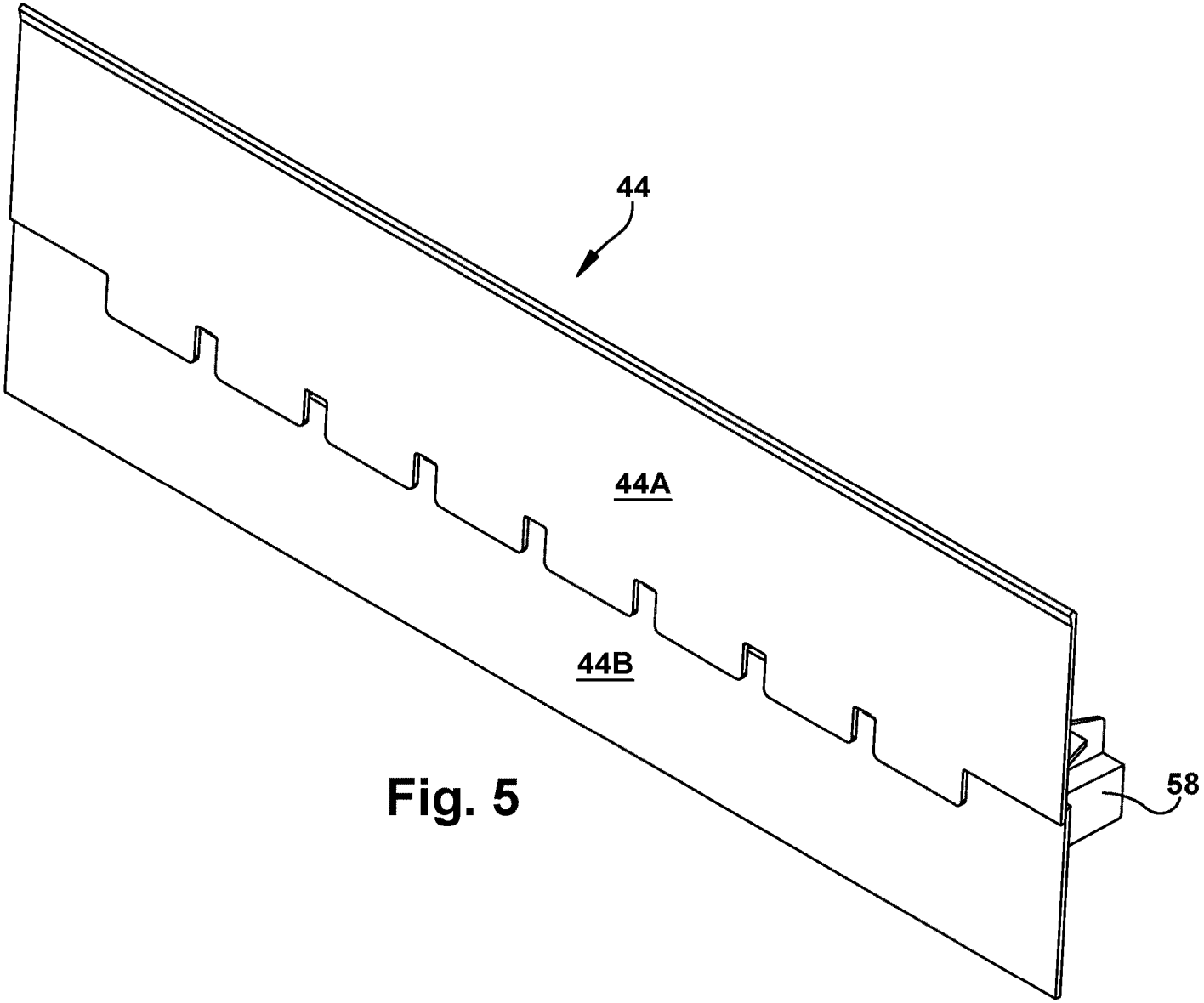
FIG. 5 is a perspective view of a flexible card row sham.
Figure 7:
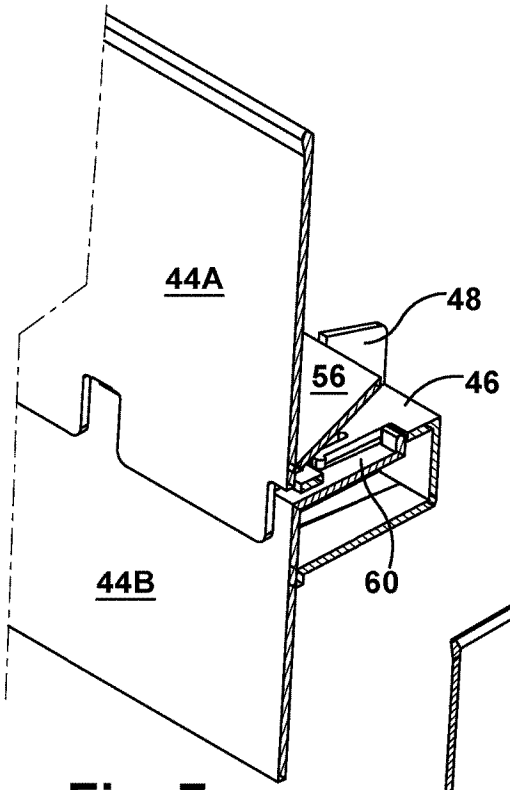
FIG. 7 is a cross-sectional view of a card tier insert and flexible card row sham.
Figure 9:
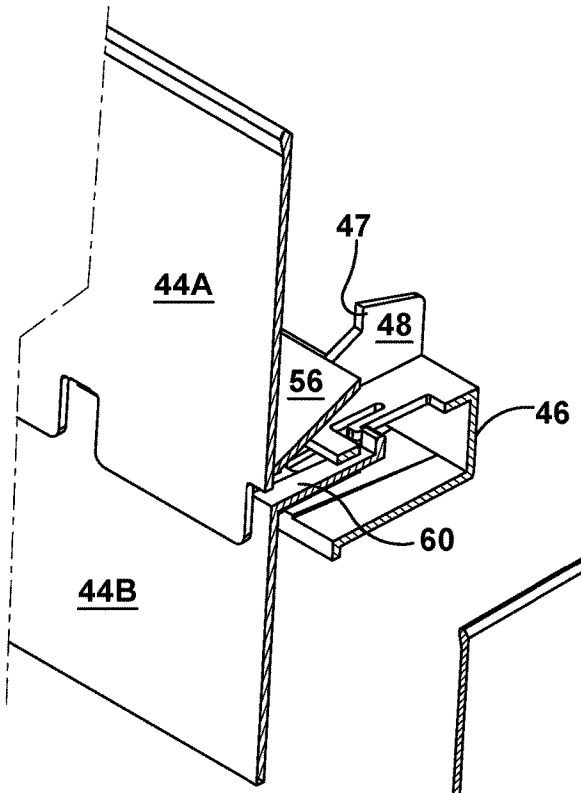
FIG. 9 is a cross-sectional view of a tier insert and flexible card row sham.
Figure 11:
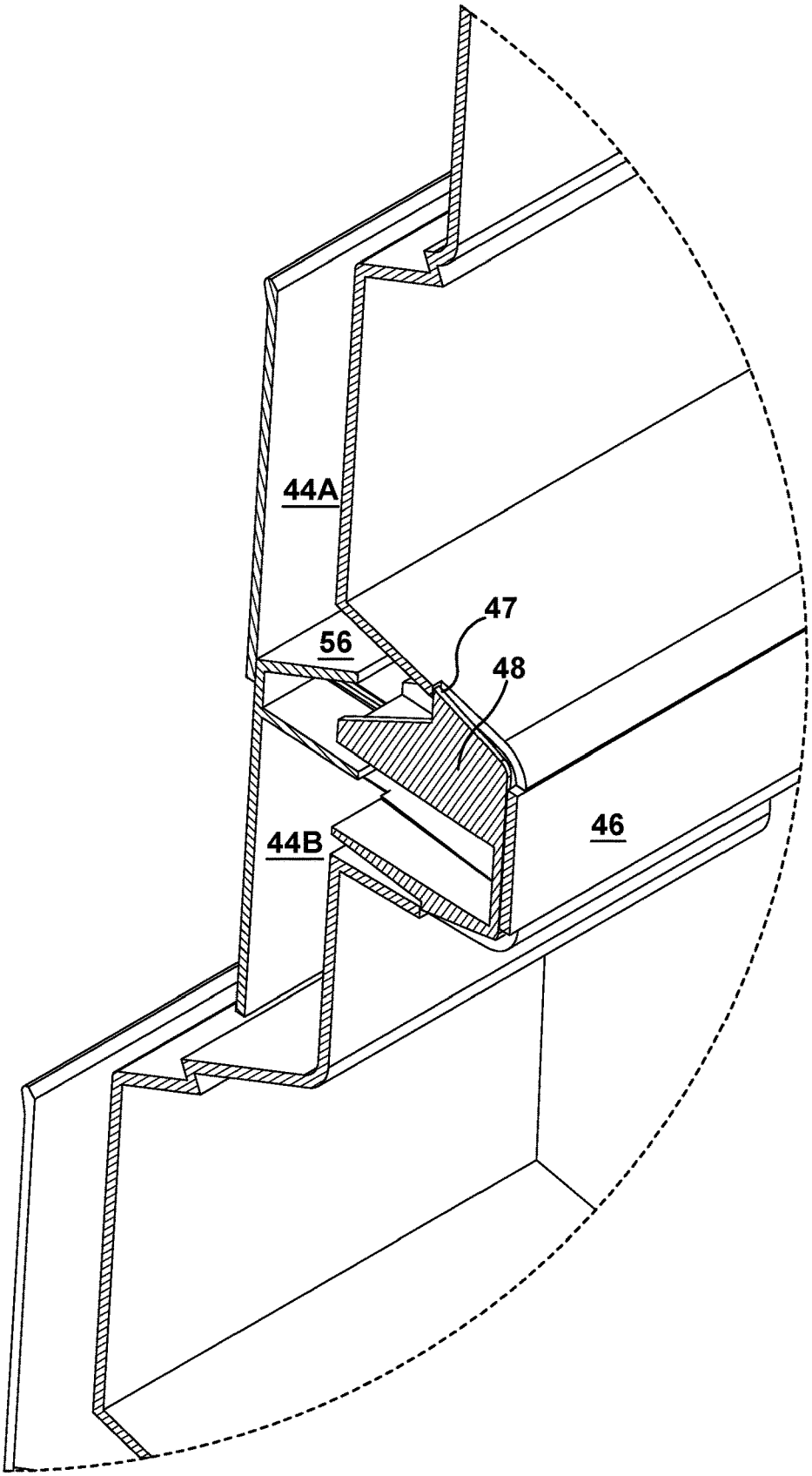
FIG. 11 is a cross-sectional view of a tier insert and flexible card row sham attached to a card tier.

Each of the plurality of flexible card rows include a two-piece flexible card row cover or sham 44, shown in FIGS. 5 and 6, which is inserted into the card tier insert 46 for attachment to the card tier 30. Each flexible card row cover or sham 44 contains two portions, an upper portion 44A and a lower portion 44B. The upper and lower portions 44A, 44B of each flexible card row cover or sham 44 are attached via snap-fit. The upper portion 44A is substantially rectangular with four perimeter sides (a top side, a bottom side opposite the top side, a right side and a left side opposite the right side), a front surface and rear a surface opposite the front surface. The bottom perimeter side of the upper portion 44A of each flexible card row cover or sham 44 contains a plurality of notches 50. The rear surface of the upper portion 44A contains a series of three tabs 52 evenly spaced along the length of the rear surface. These tabs 52 are inserted into slots, openings or apertures contain on the lower portion 44B of the flexible card row cover or sham 44. The rear surface of the upper portion of each flexible card row cover or sham may additionally contain a single tab 54 located at each horizontal distal end thereof. The lower portion 44B of each flexible card row cover or sham 44 is also substantially rectangular, having four perimeter sides (a right side, a left side opposite the right side, a top side, a bottom side opposite the top side), a front surface and a rear surface opposite the front surface. A ledge 56 is attached to rear surface of the lower portion 44B of each of the flexible card row covers or shams 44, proximate to the bottom side thereof. This ledge 56 serves as the floor or bottom support of the flexible card rows F. Beneath the ledge 56 are five (5) substantially rectangular elements 58 which extend outward from (and substantially perpendicular to) the rear surface of the lower portion 44B of each of the flexible card row covers or shams 44. These five (5) elements 58 are spaced such that they are insertable into the five (5) compartments C spaced along each card tier insert 46 to attach each flexible card row cover or sham 44 to one of the plurality of card tier inserts 46, creating a flexible card row F. Two (2) of the five (5) elements 58 contain an outward extending arm (perpendicular to each element) 60 having a small catch which extends upward from the distal end of each arm 60 (see FIG. 10). When the flexible card row shams or covers 44 are engaged with the flexible card tier inserts 46, the two (2) arms 60 are engaged with the two (2) rectangular apertures or openings 62 on an upper surface of two (2) of the five (5) compartments C in the card tier insert 46. When the flexible card row is in a closed position, the catch portion of the outward extending arm 60 is located proximate to one distal end of the rectangular aperture or opening 62, as shown in FIGS. 7 and 8, and when the flexible card row F is in an open position, the catch portion of outward extending arm 60 is located proximate to the opposite distal end of the rectangular aperture or opening 62, as shown in FIGS. 9 and 10. The catch portion of the outward extending arm 60 prevents the flexible card row sham or cover 44 from being completely removed from the card tier insert 46 and limits movement of the flexible card row sham or cover 44 to approximately 1-inch from the closed position.

In operation, a plurality of permanent card row shams or covers 42 are attached to the card tier 30 and a card tier insert 46 is inserted into each of the plurality of indented or depressed areas 36 located on the card tier 30 (between each permanent card row P). The card tier 30 may be attached to a larger greeting card fixture 34, as described above. The upper and lower portions 44A, 44B of the flexible card row tier cover or sham 44 are attached to each other via snap-fit and then inserted into each of the plurality of card tier inserts 46, as shown in FIGS. 6 through 11. The flexible card row F can now be moved between a first or closed position (see FIGS. 1, 3, 7 and 8) wherein each of the five (5) elements 58 which extend outward (and perpendicular) from the rear surface of each flexible card tier cover or sham 44 are inserted into each of the five (5) compartments C located in each card tier insert 46 (and the ledge 56 is directly above or atop the sloped or angled portion of the fins or projections 48 extending upward from the top surface of each card tier insert 46) and the flexible card tier cover or sham 44 is directly adjacent to or abutting the rear wall of a permanent card row P (or in the case of the flexible card row located at the highest elevation on the card tier 30, directly adjacent or abutting a vertical portion of the card tier 30) and a second or open position (see FIGS. 2, 4, 9 and 10) wherein the five (5) elements 58 which extend outward (and perpendicular) from the rear surface of each flexible card tier cover or sham 44 are substantially removed from each of the five (5) compartments C located in each card tier insert 46 (and the ledge 56 is moved away from the fins or projections 48 extending upward from a top surface of each card tier insert 46). The two (2) catches 60 on each flexible card row sham or cover 44 engage with the two (2) apertures or openings 62 on the card tier insert 46 to restrict the flexible card row sham or cover 44 to movement of approximately 1-inch away from the card tier insert 46 to create a 1-inch card row (see FIGS. 9 and 10). The ledge 56 serves as support for a plurality of greeting cards placed thereon. Each of the flexible card rows F may be contained between each permanent card row P so when closed, the permanent card row P has an approximate 2-inch depth (see FIG. 1) and when opened, the permanent card row P and flexible card row F each have a 1-inch depth (see FIG. 2). All flexible card rows F may be in an open position or select individual flexible card rows F may be open while others remain closed. A standard clip 32 having an inverted u-shaped channel may be placed over the front wall of each card row to divide the row up into individual compartments or pockets.

ALTERNATE EMBODIMENTS

While the two embodiments of the flexible row card tier described above have been described with respect to certain features and parameters, these embodiments have been presented as examples only and details may vary between embodiments with some of the features of the first embodiment being paired with some of the features of the second embodiment. Alternate embodiments may also be created by varying the features and parameters as described above with respect to the first and second embodiments. For example, in other embodiments, the card tier may be split into two separate sections, an upper section and a lower section, to provide more flexibility to the greeting card display wherein one section of the tier may be removed and replaced with another insert to accommodate the display of non-greeting card merchandise. Also, while a certain number of permanent and flexible card rows have been disclosed herein and shown in the figures having a standard positioning thereof (flexible card row between each permanent card row), other numbers and position of each type of card row have been contemplated and are considered to be within the scope of the present invention. Also, specific shapes, sizes, placement, locations, configurations and number of the various parts which make up the invention have been disclosed with respect the two embodiments presented herein as examples of the invention. The shapes, sizes, placement, locations, configurations and number of the various components may be modified and still remain within the scope of the present invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A flexible card tier system comprising:

a card tier having a plurality of open-sided cavities formed within back walls of the card tier;

a plurality of permanent card rows;

a plurality of card tier inserts, each of the plurality of card tier inserts inserted into one of the plurality of open-sided cavities of the card tier;

a plurality of permanent card row covers attached to the card tier;

a plurality of flexible card row covers attached to the plurality of card tier inserts to define a plurality of flexible card rows, the plurality of flexible card row covers operative to move between an open position and a closed position;

wherein the flexible card row covers are each placed between two corresponding permanent card rows; and wherein the flexible card row covers being in the closed position results in corresponding permanent card rows each being one large card row respectively and the flexible card row covers being in the open position results in the corresponding permanent card rows each being two small card rows respectively.

2. The flexible card tier of claim 1, wherein each flexible card row cover moves between the open position and the closed position via a catch arm on each of the plurality of flexible card row covers which interacts with a corresponding open side cavity on each of the plurality of card tier inserts respectively.

3. The flexible card tier of claim 1, wherein each of the plurality of flexible card rows contains a floor which supports and elevates greeting cards placed onto the plurality of flexible card rows above greeting cards on the corresponding permanent card rows located below the flexible card rows.

4. The flexible card tier of claim 1, wherein the card tier is operative to attach to a retail display.

5. A flexible row card tier system comprising:

a card tier having various tiers or steps defining permanent card rows, arranged in a downward cascading manner wherein beginning with a corresponding uppermost permanent card row, each successive tier or step projects downward and outward from each preceding step, with each permanent card row being at a lower elevation and a position slightly in front of the corresponding permanent card row directly above;

one or more flexible card rows attached to the card tier, each flexible card row comprises a card tier insert and a flexible card row sham or cover, each flexible card row sham or cover being operative to move between an open position and a closed position;

each of the permanent card rows comprising a first depth and a permanent card row sham or cover as a front wall thereof;

wherein each of the one or more flexible card rows are positioned above one of the plurality of permanent card rows; and wherein when each flexible card row sham or cover of the one or more flexible card rows is in the open position, the first depth of a respective permanent card row located directly below each of the one or more flexible card rows is reduced by half; and wherein when each flexible card row sham or cover of the one or more flexible card rows is in the closed position, each respective permanent card row returns to the first depth.

6. The flexible row card tier of claim 5, wherein each flexible card row sham or cover is able to move between the open position and the closed position via interaction between one or more catch arms contained on each flexible card row sham or cover and one or more openings contained on each card tier insert respectively.

7. The flexible card row tier of claim 5, wherein the card tier inserts are inserted into cavities or openings on the card tier.

8. The flexible card row tier of claim 5, wherein each flexible card row comprises a floor which supports and elevates greeting cards placed onto each flexible card row above the greeting cards on the respective permanent card row located directly below each flexible card row respectively.

9. The flexible card tier of claim 5, wherein the first depth of each of the plurality of permanent card rows is 1-inch when each corresponding flexible card row located directly above each of the respective permanent card rows is in the open position and 2 inches when the corresponding flexible card row located directly above each of the respective permanent card rows respectively is in the closed position.

10. The flexible card tier of claim 5, wherein each flexible card row can be retained in the open position or the closed position via interaction between each flexible card row sham or cover and each tier insert, respectively.

11. A flexible row card tier system comprising:

a card tier having various tiers or steps that define rows, arranged in a downward cascading manner wherein beginning with an uppermost row, each successive tier or step projects downward and outward from each preceding step, with each row of each tier or step being at a lower elevation and a position slightly in front of a corresponding row of a corresponding tier directly above, the card tier also having one or more depressions or indentions therein, and a plurality of slots or openings;

one or more card tier inserts which are inserted into the one or more depressions or indentions on the card tier and secured thereto;

one or more flexible card row shams or covers which are attached to the one or more card tier inserts, the one or more flexible card row shams or covers operative to move between an open position and a closed position;

a plurality of permanent card row shams or covers which are inserted into the plurality of slots or openings on the card tier;

wherein each of the one or more flexible card row shams or covers are located above one of the plurality of permanent card row shams or covers; and wherein when each of the one or more flexible card row shams or covers is in the open position, each of the one or more flexible card row shams or covers creates an extra row by dividing a depth of a corresponding permanent card row directly below each one or more flexible card row shams or covers in half.

12. The flexible card row tier of claim 11, wherein each of the one or more flexible card row shams or covers contains at least one arm having a catch extending outward from a rear surface thereof.

13. The flexible card row tier of claim 12, wherein each of the one or more tier inserts contains at least one opening therein.

14. The flexible card row tier of claim 13, wherein the at least one arm having a catch on each of the at one or more flexible card row shams or covers interacts with the at least one opening of each of the one or more tier inserts to allow the one or more flexible card row shams or covers to move between the open position and the closed position.

15. The flexible card row tier of claim 11, wherein each of the one or more flexible card row shams or covers comprises a ledge or floor which supports and elevates greeting cards placed onto each of the one or more flexible card row shams or covers above greeting cards on a corresponding permanent card row located below each of the one or more flexible card row shams or covers.

16. The flexible card tier of claim 11, wherein the card tier is operative to attach to a retail display.

* * * * *